US009782657B2

(12) United States Patent
Hou

(10) Patent No.: US 9,782,657 B2
(45) **Date of Patent: *Oct. 10, 2017**

(54) UNIVERSAL SWING TRAINING APPARATUS

(71) Applicant: Best Swing One, LLC, Westlake Village, CA (US)

(72) Inventor: Wen-Sun Hou, Westlake Village, CA (US)

(73) Assignee: BEST SWING ONE, LLC, Westlake, Village, CA (US)

( * ) Notice: Subject to any disclaimer, the term of this patent is extended or adjusted under 35 U.S.C. 154(b) by 89 days.

This patent is subject to a terminal disclaimer.

(21) Appl. No.: 14/880,224

(22) Filed: Oct. 10, 2015

(65) Prior Publication Data

US 2016/0030828 A1 Feb. 4, 2016

Related U.S. Application Data

(63) Continuation-in-part of application No. 14/690,309, filed on Apr. 17, 2015, now Pat. No. 9,387,383, and
(Continued)

(51) Int. Cl.
*A63B 15/00* (2006.01)
*A63B 59/00* (2015.01)
(Continued)

(52) U.S. Cl.
CPC ..... *A63B 69/38* (2013.01); *A63B 15/00* (2013.01); *A63B 53/10* (2013.01); *A63B 60/16* (2015.10);
(Continued)

(58) Field of Classification Search
CPC . A63B 69/38; A63B 69/0002; A63B 69/3623; A63B 69/3635; A63B 15/00;
(Continued)

(56) References Cited

U.S. PATENT DOCUMENTS 335,656 A 2/1886 Taylor
537,927 A 4/1895 Kennedy
(Continued)

OTHER PUBLICATIONS

Aryanpour, M., U.S. *Ex Parte Quayle* Action, U.S. Appl. No. 14/690,309, Feb. 11, 2016, pp. 1-14.
(Continued)

*Primary Examiner* — Sebastiano Passaniti
(74) *Attorney, Agent, or Firm* — Lyon & Harr, LLP; Richard T. Lyon

(57) ABSTRACT

A universal swing training apparatus is provided that includes a sports-related implement and a slide mechanism. The implement includes a proximal section and a distal section that are spaced apart to form a gap there-between. The slide mechanism is inserted within this gap and is connected to the upper end of the proximal section and the lower end of the distal section. The slide mechanism includes a rail guide, a plurality of front ball bearings, a plurality of rear ball bearings, and a sliding rail assembly that are cooperatively configured to insure that this upper end and this lower end are coaxial when the sliding rail assembly is situated in a coaxial position on the rail guide, and permit a lateral shift of this lower end relative to this upper end during a swinging of the implement.

24 Claims, 15 Drawing Sheets

Related U.S. Application Data a continuation-in-part of application No. 14/193,960, filed on Feb. 28, 2014, now Pat. No. 9,126,091, and a continuation-in-part of application No. 13/783,034, filed on Mar. 1, 2013, now Pat. No. 8,915,793.

(51) Int. Cl.

| | |
|---|---|
| ***A63B 69/00*** | (2006.01) |
| ***A63B 69/36*** | (2006.01) |
| ***A63B 49/08*** | (2015.01) |
| ***A63B 69/38*** | (2006.01) |
| ***A63B 53/10*** | (2015.01) |
| ***A63B 60/24*** | (2015.01) |
| ***A63B 60/16*** | (2015.01) |
| *A63B 71/06* | (2006.01) |
| *A63B 60/00* | (2015.01) |

(52) U.S. Cl.

CPC ..... *A63B 60/24* (2015.10); *A63B 69/0002* (2013.01); *A63B 69/3623* (2013.01); *A63B 69/3635* (2013.01); *A63B 69/3632* (2013.01); *A63B 2060/0081* (2015.10); *A63B 2069/0008* (2013.01); *A63B 2071/0602* (2013.01); *A63B 2071/0625* (2013.01); *A63B 2071/0655* (2013.01); *A63B 2208/0204* (2013.01); *Y10T 29/49817* (2015.01)

(58) Field of Classification Search

CPC ..... A63B 53/10; A63B 60/24; A63B 60/16; A63B 2069/0008; A63B 2208/0204; A63B 2071/0602; A63B 2071/0625; A63B 2071/0655; A63B 2060/0081; A63B 69/3632; Y10T 29/49817

USPC ..... 473/232–234, 226, 294, 296, 316, 324, 473/409, 219, 239, 422, 238, 297, 457, 473/451, 521, 538, 519, 564–568; 29/426.2

See application file for complete search history.

(56) References Cited

U.S. PATENT DOCUMENTS

| | | | | |
|---|---|---|---|---|
| 546,540 | A | 9/1895 | Kennedy | |
| 695,579 | A | 3/1902 | Parmele | |
| 1,428,015 | A | 9/1922 | Dienner | |
| 1,509,733 | A | 9/1924 | Langford | |
| 1,529,305 | A | 3/1925 | Gatke | |
| 2,158,211 | A | 5/1939 | Aitken | |
| 2,159,579 | A | 5/1939 | Whitney | |
| 2,772,887 | A | 12/1956 | Blake | |
| 3,180,308 | A | 4/1965 | Carroli et al. | |
| 3,341,203 | A | 9/1967 | Brill | |
| 3,414,260 | A | 12/1968 | Gust | |
| 3,428,325 | A | 2/1969 | Atkinson | |
| 3,679,205 | A | 7/1972 | Finkle | |
| 3,953,035 | A | 4/1976 | Beckisk | |
| 4,027,886 | A | 6/1977 | Katsube | |
| 4,145,054 | A | 3/1979 | Stewart | |
| 4,249,729 | A | 2/1981 | Gabrielidis | |
| 4,367,871 | A | 1/1983 | Schiefer | |
| 4,399,996 | A | 8/1983 | Boyce | |
| 4,555,111 | A | 11/1985 | Alvarez | |
| 4,576,378 | A | 3/1986 | Backus | |
| 4,614,343 | A | 9/1986 | Radway | |
| 4,746,119 | A | 5/1988 | Jeanrot | |
| 4,854,585 | A | 8/1989 | Koch et al. | |
| 4,932,661 | A | 6/1990 | Choi | |
| 4,969,921 | A | 11/1990 | Silvera | |
| 5,026,064 | A | 6/1991 | Novosel | |
| 5,037,103 | A | 8/1991 | Williams et al. | |
| 5,082,283 | A | 1/1992 | Conley et al. | |
| 5,143,373 | A | 9/1992 | Meissner | |
| 5,143,376 | A | 9/1992 | Johnson | |
| 5,195,748 | A | 3/1993 | Koch | |
| 5,226,652 | A | 7/1993 | Sato | |
| 5,277,427 | A | 1/1994 | Bryan et al. | |
| 5,372,557 | A | 12/1994 | Ostigny | |
| 5,415,406 | A | 5/1995 | Reichenbach et al. | |
| 5,467,993 | A | 11/1995 | Higginson | |
| 5,516,097 | A | 5/1996 | Huddlestron | |
| 5,527,039 | A | 6/1996 | Levesque | |
| 5,580,321 | A | 12/1996 | Rennhack | |
| 5,588,920 | A | 12/1996 | Soong | |
| 5,616,087 | A | 4/1997 | Bothwell | |
| 5,700,205 | A | 12/1997 | Sanford | |
| 5,735,752 | A | 4/1998 | Antonious | |
| 5,860,871 | A | 1/1999 | Marley, Jr. | |
| 5,941,779 | A | 8/1999 | Zeiner-Gundersen | |
| 6,012,988 | A | 1/2000 | Burke | |
| 6,059,668 | A | 5/2000 | Marley, Jr. | |
| 6,071,199 | A | 6/2000 | Suzuki | |
| 6,241,629 | B1 | 6/2001 | Otto | |
| 6,257,992 | B1 | 7/2001 | LeBlanc | |
| 6,358,157 | B1 | 3/2002 | Sorenson | |
| 6,440,005 | B1 | 8/2002 | Hubenig | |
| 6,569,042 | B2 | 5/2003 | LaChance | |
| 6,625,848 | B1 | 9/2003 | Schneider | |
| 6,881,156 | B1 | 4/2005 | Philips | |
| 7,018,302 | B2 | 3/2006 | Jacoby | |
| 7,041,000 | B1 | 5/2006 | Galloway | |
| 7,074,133 | B1 | 7/2006 | Jones et al. | |
| 7,235,024 | B2 | 6/2007 | Lefebvre | |
| 7,285,055 | B2 | 10/2007 | Radle | |
| 7,297,077 | B1 | 11/2007 | Battaglino | |
| 7,416,492 | B2 | 8/2008 | Wesley | |
| 7,455,595 | B1 | 11/2008 | Gibbons et al. | |
| 8,348,779 | B2 | 1/2013 | Kim | |
| 8,491,423 | B1 | 7/2013 | Biggio | |
| 8,915,793 | B2 * | 12/2014 | Hou | A63B 15/00 473/232 |
| 9,126,091 | B2 * | 9/2015 | Hou | A63B 69/3635 |
| 9,387,383 | B2 * | 7/2016 | Hou | A63B 69/3623 |
| 2004/0162167 | A1 | 8/2004 | Stevens | |
| 2006/0122000 | A1 | 6/2006 | Paredes et al. | |
| 2007/0275788 | A1 | 11/2007 | Delpine | |
| 2010/0167830 | A1 | 7/2010 | Hinton et al. | |
| 2012/0064986 | A1 | 3/2012 | Brooks | |
| 2013/0267340 | A1 | 10/2013 | Wolf | |

OTHER PUBLICATIONS

Passaniti, S., U.S. Office Action, U.S. Appl. No. 13/783,034, Jul. 29, 2014, pp. 1-7.

Passaniti, S., U.S. Notice of Allowance, U.S. Appl. No. 13/783,034, Oct. 29, 2014, pp. 1-8.

Passaniti, S., U.S. Office Action, U.S. Appl. No. 14/193,960, Mar. 26, 2015, pp. 1-9.

Passaniti, S., U.S. Notice of Allowance, U.S. Appl. No. 14/193,960, Jun. 10, 2015, pp. 1-7.

* cited by examiner

FIG. 24
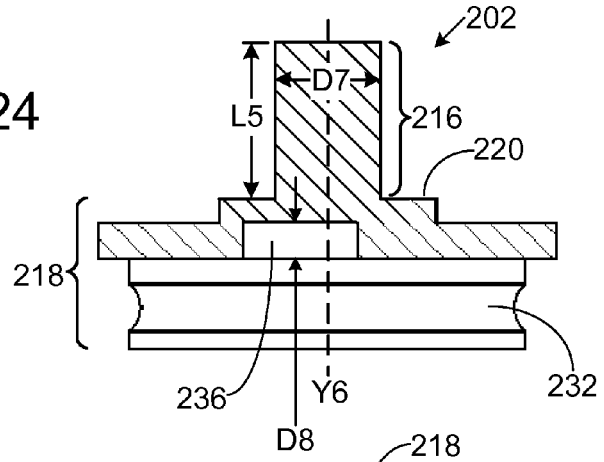
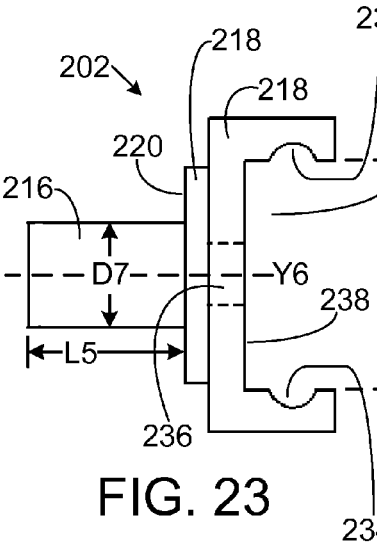
FIG. 23
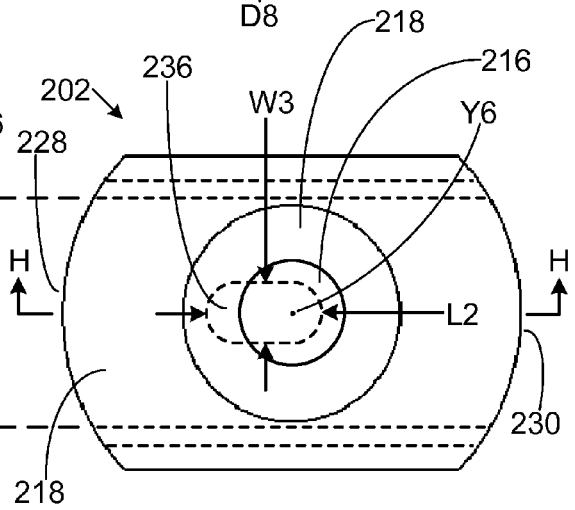
FIG. 22
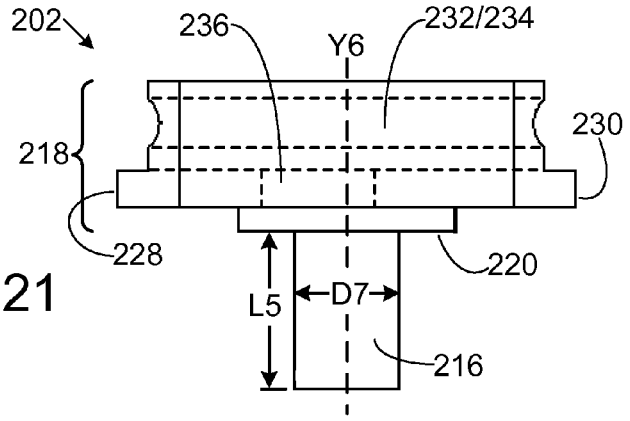
FIG. 21

UNIVERSAL SWING TRAINING APPARATUS

CROSS REFERENCE TO RELATED APPLICATIONS

This application is a continuation-in-part of U.S. application Ser. No. 14/690,309 which was filed Apr. 17, 2015, which is a continuation-in-part of U.S. application Ser. No. 14/193,960 which was filed Feb. 28, 2014 and subsequently issued as U.S. Pat. No. 9,126,091, which is a continuation-in-part of U.S. application Ser. No. 13/783,034 which was filed Mar. 1, 2013 and subsequently issued as U.S. Pat. No. 8,915,793. The disclosure of application Ser. Nos. 14/690,309, 14/193,960 and 13/783,034 is hereby incorporated by reference.

BACKGROUND

Many sports and recreational activities involve a person swinging a given type of sports-related implement. For example, in the sport of golf a golfer swings a golf club in an attempt to hit a golf ball. In the sport of baseball a batter swings a baseball bat in an attempt to hit a baseball. In the sport of tennis a tennis player swings a tennis racket (also known as a tennis racquet) in an attempt to hit a tennis ball.

SUMMARY

Training apparatus embodiments described herein generally involve a swing training apparatus. In one exemplary embodiment a universal swing training apparatus includes a sports-related implement and a slide mechanism. The implement includes two separate and distinct sections spaced apart to form a gap there-between, where these sections include a proximal section and a distal section. The slide mechanism is inserted within this gap and is connected to the upper end of the proximal section and the lower end of the distal section. The slide mechanism includes a rail guide, a plurality of front ball bearings, a plurality of rear ball bearings, and a sliding rail assembly that are cooperatively configured to insure that this upper end and this lower end are coaxial when the sliding rail assembly is situated in a coaxial position on the rail guide, and permit a lateral shift of this lower end relative to this upper end during a swinging of the implement.

In another exemplary embodiment a golf club swing training apparatus includes a golf club shaft and a slide mechanism. The shaft has a butt end and a head end, and includes two separate and distinct portions spaced apart to form a gap there-between, where these portions include an upper shaft portion that includes the butt end of the shaft and a lower shaft portion that includes the head end of the shaft. The slide mechanism is inserted within this gap and is connected to the lower end of the upper shaft portion and the upper end of the lower shaft portion. The slide mechanism includes a rail guide, a plurality of front ball bearings, a plurality of rear ball bearings, and a sliding rail assembly that are cooperatively configured to insure that this lower end and this upper end are coaxial when the sliding rail assembly is situated in a coaxial position on the rail guide, and permit a lateral shift of this upper end relative to this lower end during a swinging of the club.

In yet another exemplary embodiment a baseball bat swing training apparatus includes a baseball bat and a slide mechanism. The bat includes two separate and distinct sections spaced apart to form a gap there-between, where these sections include a handle section and a barrel section. The slide mechanism is inserted within this gap and is connected to the upper end of the handle section and the lower end of the barrel section. The slide mechanism includes a rail guide, a plurality of front ball bearings, a plurality of rear ball bearings, and a sliding rail assembly that are cooperatively configured to insure that this upper end and this lower end are coaxial when the sliding rail assembly is situated in a coaxial position on the rail guide, and permit a lateral shift of this lower end relative to this upper end during a swinging of the bat.

In yet another exemplary embodiment a tennis racket swing training apparatus includes a tennis racket and a slide mechanism. The racket includes a handle section, a head section, and a throat section that rigidly interconnects the handle and head sections. The handle section includes two separate and distinct portions spaced apart to form a gap there-between, where these portions include an upper portion and a lower portion. The slide mechanism is inserted within this gap and is connected to the upper end of the lower portion of the handle section and the lower end of the upper portion of the handle section. The slide mechanism includes a rail guide, a plurality of front ball bearings, a plurality of rear ball bearings, and a sliding rail assembly that are cooperatively configured to insure that this upper end and this lower end are coaxial when the sliding rail assembly is situated in a coaxial position on the rail guide, and permit a lateral shift of this lower end relative to this upper end during a swinging of the racket.

It should be noted that the foregoing Summary is provided to introduce a selection of concepts, in a simplified form, that are further described below in the Detailed Description. This Summary is not intended to identify key features or essential features of the claimed subject matter, nor is it intended to be used as an aid in determining the scope of the claimed subject matter. Its sole purpose is to present some concepts of the claimed subject matter in a simplified form as a prelude to the more-detailed description that is presented below.

DESCRIPTION OF THE DRAWINGS

The specific features, aspects, and advantages of the training apparatus embodiments described herein will become better understood with regard to the following description, appended claims, and accompanying drawings where:

FIG. 21 is a diagram illustrating a standalone transparent plan view, in simplified form, of an exemplary embodiment of the post-based rail guide of the post-based slide mechanism of FIG. 16.

FIG. 22 is a diagram illustrating a transparent bottom view, in simplified form, of the post-based rail guide of FIG. 21.

FIG. 23 is a diagram illustrating a transparent plan view, in simplified form, of the post-based rail guide of FIG. 22 rotated left 90 degrees.

FIG. 24 is a diagram illustrating a cross-sectional view, in simplified form, of the post-based rail guide of FIG. 21 taken along line H-H of FIG. 22.

DETAILED DESCRIPTION

Figure 1:
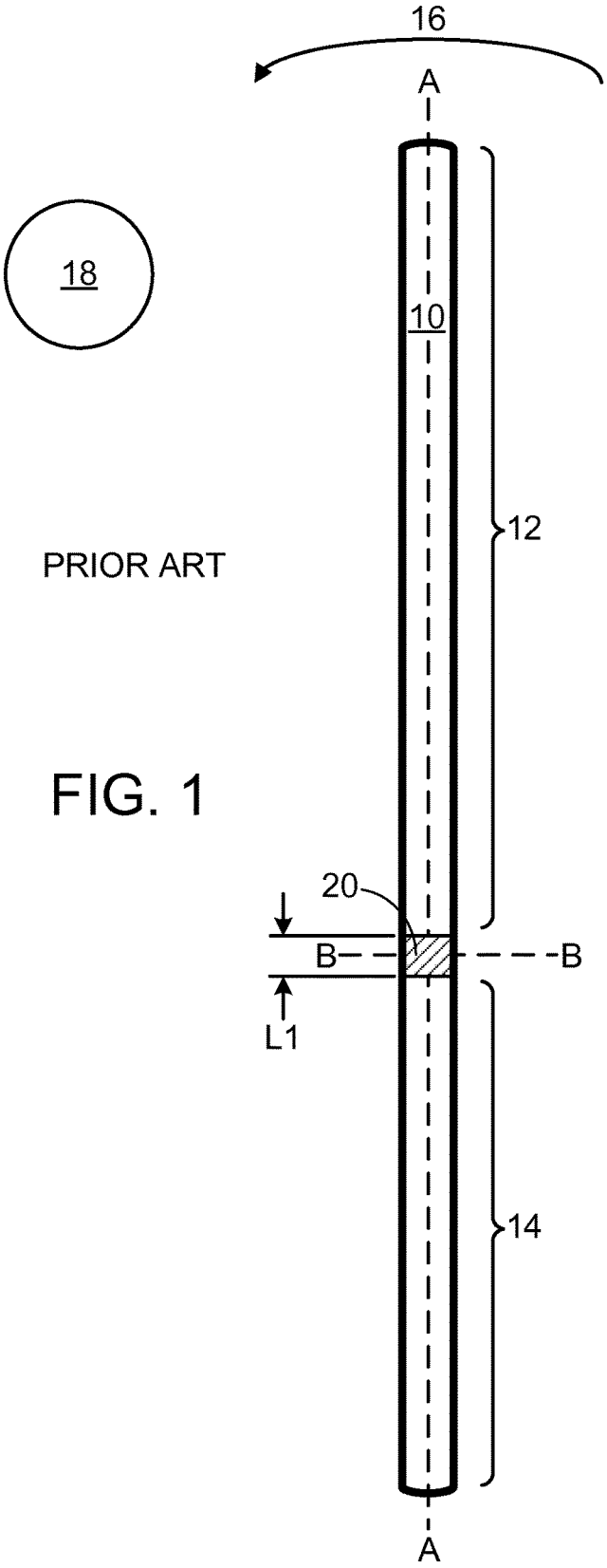
PRIOR ART FIG. 1
FIG. 1 is a diagram illustrating a plan view, in simplified form, of an exemplary embodiment of a conventional sports-related implement and a conventional object that is related to the implement, where a person swings the implement in an attempt to hit the object.

In the following description of training apparatus embodiments reference is made to the accompanying drawings which form a part hereof, and in which are shown, by way of illustration, specific embodiments in which the training apparatus can be practiced. It is understood that other embodiments can be utilized and structural changes can be made without departing from the scope of the training apparatus embodiments.

It is also noted that for the sake of clarity specific terminology will be resorted to in describing the training apparatus embodiments described herein and it is not intended for these embodiments to be limited to the specific terms so chosen. Furthermore, it is to be understood that each specific term includes all its technical equivalents that operate in a broadly similar manner to achieve a similar purpose. Reference herein to "one embodiment", or "another embodiment", or an "exemplary embodiment", or an "alternate embodiment", or "one implementation", or "another implementation", or an "exemplary implementation", or an "alternate implementation", or "one version", or "another version", or an "exemplary version", or an "alternate version" means that a particular feature, a particular structure, or particular characteristics described in connection with the embodiment or implementation can be included in at least one embodiment of the training apparatus. The appearances of the phrases "in one embodiment", "in another embodiment", "in an exemplary embodiment", "in an alternate embodiment", "in one implementation", "in another implementation", "in an exemplary implementation", "in an alternate implementation", "in one version", "in another version", "in an exemplary version", and "in an alternate version" in various places in the specification are not necessarily all referring to the same embodiment or implementation or version, nor are separate or alternative embodiments/implementations/versions mutually exclusive of other embodiments/implementations/versions. Yet furthermore, the order of process flow representing one or more embodiments or implementations or versions of the training apparatus does not inherently indicate any particular order nor imply any limitations of the training apparatus.

Yet furthermore, to the extent that the terms "includes," "including," "has," "contains," variants thereof, and other similar words are used in either this detailed description or the claims, these terms are intended to be inclusive, in a manner similar to the term "comprising", as an open transition word without precluding any additional or other elements.

1.0 Universal Swing Training Apparatus

The training apparatus embodiments described herein generally involve a universal swing training apparatus that a person can use to improve the mechanics of how they swing a given type of sports-related implement. As will be appreciated from the more-detailed description that follows, the training apparatus embodiments are applicable to any type of sports-related implement that a person swings including, but not limited to, a golf club, a baseball bat, and a tennis racket. Generally speaking and as will be described in more detail hereafter, the training apparatus embodiments include the sports-related implement and a slide mechanism which is interposed (e.g., installed) into the implement in a manner that converts the implement into an implement swing training apparatus. More particularly and by way of example but not limitation, in one embodiment of the training apparatus the sports-related implement is a conventional golf club and the slide mechanism is interposed into the golf club in a manner that converts it into a golf club swing training apparatus. In another embodiment of the training apparatus the sports-related implement is a conventional baseball bat and the slide mechanism is interposed into the baseball bat in a manner that converts it into a baseball bat swing training apparatus. In yet another embodiment of the training apparatus the sports-related implement is a conventional tennis racket and the slide mechanism is interposed into the tennis racket in a manner that converts it into a tennis racket swing training apparatus.

FIG. 1 illustrates a plan view, in simplified form, of an exemplary embodiment of a conventional sports-related implement that is swung by a person in an attempt to hit a conventional object that is related to the implement. As exemplified in FIG. 1, the sports-related implement 10 generally includes two different longitudinal sections, namely a proximal section 14 and a distal section 12. The person grips a portion of the proximal section 14 of the implement 10 with either one or both of their hands and forcibly swings 16 the implement 10 in an attempt to hit the object 18 with a portion of the distal section 12 of the implement 10. In an exemplary embodiment of the training apparatus described herein the implement 10 is cut through transversely along its longitudinal axis A-A (e.g., the implement 10 is cut through in a direction that is orthogonal to the axis A-A) approximately at the boundary B-B between the lower end of the distal section 12 of the implement 10 and the upper end of the proximal section 14 of the implement 10, and a small longitudinal section 20 of the implement 10 is removed. This cutting of the implement 10 thus separates the distal section 12 from the proximal section 14 and forms a gap there-between. After the longitudinal section 20 of the implement 10 has been removed, the slide mechanism (not shown, but various embodiments of which are described in more detail hereafter) is inserted within this gap in a manner that enables the distal section 12 to move/shift transversely/laterally a prescribed small distance relative to the proximal section 14 when the person swings 16 the implement 10 in a desired manner. In an exemplary implementation of the just-described training apparatus embodiment the longitudinal section 20 of the implement 10 that is removed has a length L1 which is selected such that the length of the implement 10 after the slide mechanism has been interposed there-within is the same as the original length of the implement 10 before it is cut.

Figure 2:
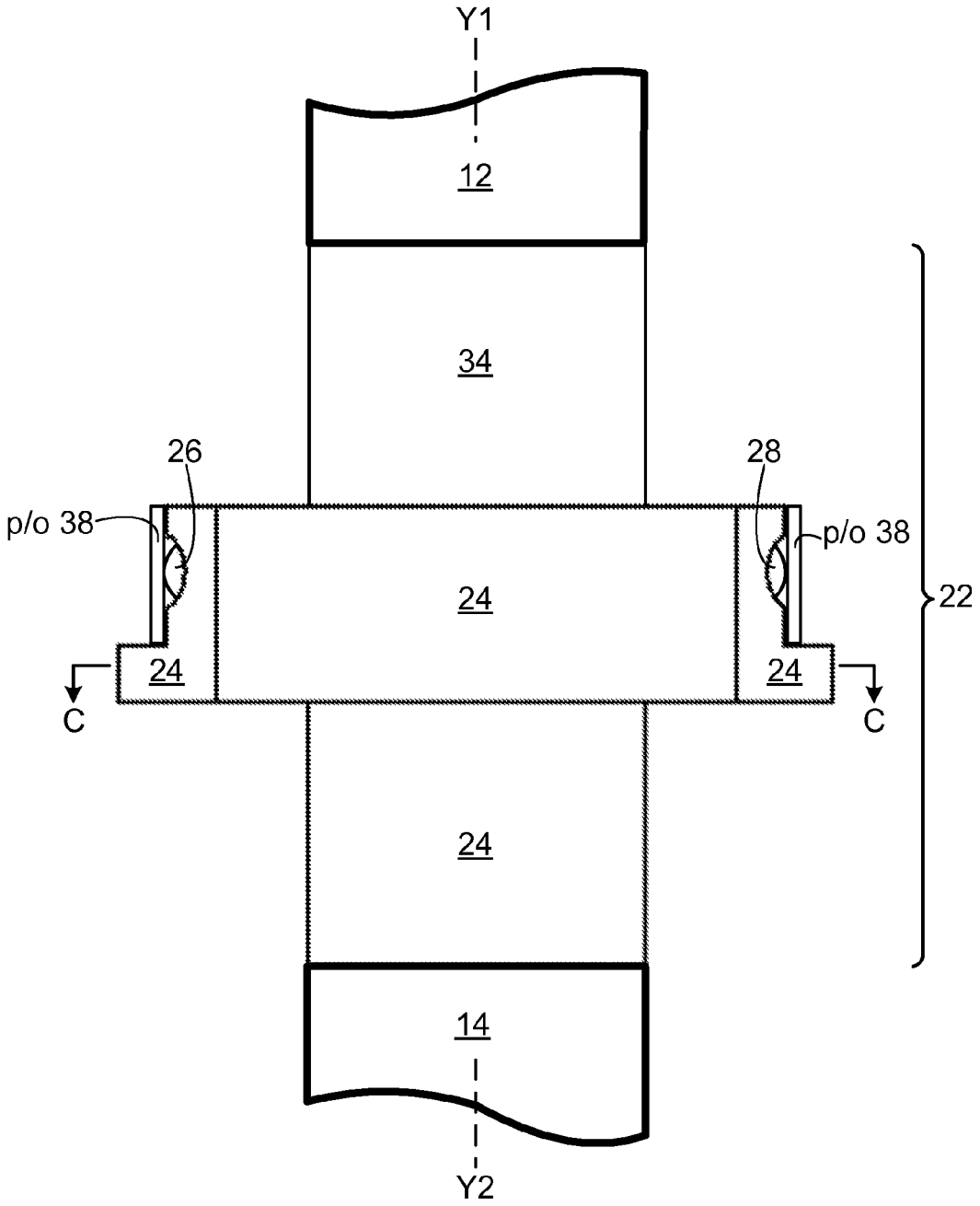
FIG. 2 is a diagram illustrating a plan view, in simplified form, of an exemplary embodiment of a slide mechanism shown connected in-between the lower end of a distal section of the sports-related implement and the upper end of a proximal section of the implement, where the slide mechanism includes a sliding rail assembly, a rail guide, and a plurality of ball bearings, the sliding rail assembly is securely connected to this lower end such that the sliding rail assembly and this lower end are coaxial, the rail guide is securely connected to this upper end such that the rail guide and this upper end are coaxial, and the sliding rail assembly is situated in a coaxial position on the rail guide such that these lower and upper ends are coaxial.

FIG. 2 illustrates a plan view, in simplified form, of an exemplary embodiment of the slide mechanism 22 shown connected in-between the lower end of the distal section 12 of the sports-related implement and the upper end of the proximal section 14 of the implement. As exemplified in FIG. 2, the slide mechanism 22 includes a rail guide 24, a plurality of front ball bearings (e.g., front ball bearings 26 and 28), a plurality of rear ball bearings (not shown), and a sliding rail assembly that includes a sliding rail member 34, a slide-limiting member (not shown), and a ball bearing retainer feature 38. As will be described in more detail hereafter, the sliding rail assembly is securely (e.g., retainably) connected to the lower end of the distal section 12 in a manner that insures the sliding rail assembly and this lower end are coaxial regardless of how the implement is swung. The rail guide 24 is securely connected to the upper end of the proximal section 14 in a manner that insures the rail guide and this upper end are coaxial regardless of how the implement is swung. The sliding rail assembly shown in FIG. 2 is situated in a coaxial position on the rail guide 24 such that the longitudinal axis Y1 of the lower end of the distal section 12 of the implement is aligned with the longitudinal axis Y2 of the upper end of the proximal section 14 of the implement (e.g., these lower and upper ends are coaxial when the sliding rail assembly is situated in the coaxial position). As will be appreciated from the more-detailed description of the slide mechanism 22 that follows, when a person is holding the implement in preparation to swing it (e.g., when a golfer is holding their golf club and performs a backswing of the club, or when a batter is holding their baseball bat with its barrel section raised behind their head and above one of their shoulders, or when a tennis player is holding their tennis racket and performs a backswing of the racket) the sliding rail assembly and the lower end of the distal section 12 of the sports-related implement will naturally move/shift in unison to the just-described coaxial position.

Figure 3:
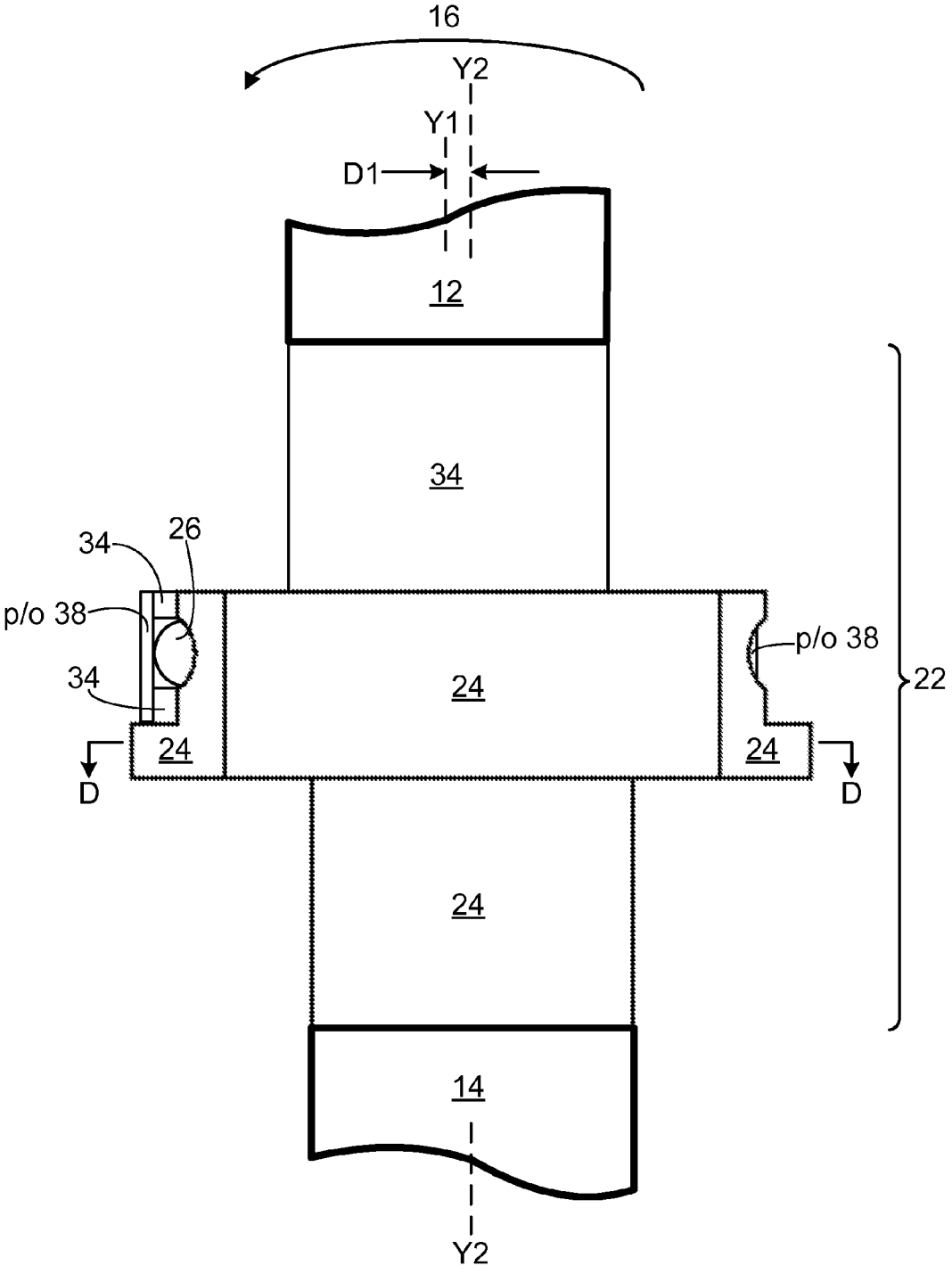
FIG. 3 is a diagram illustrating a plan view, in simplified form, of the slide mechanism of FIG. 2 where the sliding rail assembly is situated in a maximally non-coaxial position on the rail guide such that the lower end of the distal section of the sports-related implement is transversely offset/shifted a prescribed distance from the upper end of the proximal section of the implement.

FIG. 3 illustrates a plan view, in simplified form, of the slide mechanism 22 of FIG. 2 where the sliding rail assembly is situated in a maximally non-coaxial position on the rail guide 24 such that the longitudinal axis Y1 of the lower end of the distal section 12 of the sports-related implement is transversely/laterally offset/shifted a prescribed maximum rail travel distance D1 from the longitudinal axis Y2 of the upper end of the proximal section 14 of the implement. As is described herein, this transverse/lateral offset between the lower end of the distal section 12 and the upper end of the proximal section 14 can be caused by forces incurred during a desired swing 16 of the implement. It is noted that the size of the maximum rail travel distance D1 and the related difference between length L2 and diameter D2 (which are described in more detail hereafter) shown in the accompanying drawings are exaggerated in order to make them more visible.

Referring again to FIGS. 2 and 3, as will be appreciated from the more-detailed description of the slide mechanism 22 that follows, in one embodiment of the slide mechanism 22 the just-described coaxial position equates to the sliding rail assembly being situated in a rightmost position on the rail guide 24, and the just-described maximally non-coaxial position equates to the sliding rail assembly being situated in a leftmost position on the rail guide 24 (e.g., the aforementioned transverse/lateral movement/offset/shift occurs in a leftward direction from the rightmost position). In an alternate embodiment of the slide mechanism 22 the coaxial position equates to the sliding rail assembly being situated in a central position on the rail guide 24, and the maximally non-coaxial position equates to the sliding rail assembly being situated in either a leftmost position on the rail guide 24 or a rightmost position on the rail guide 24 (e.g., the transverse/lateral movement/offset/shift occurs in a leftward direction when the sports-related implement is swung leftward (e.g., from a person's right to their left), and the transverse/lateral movement/offset/shift occurs in a rightward direction when the sports-related implement is swung rightward (e.g., from a person's left to their right)).

Figure 4:
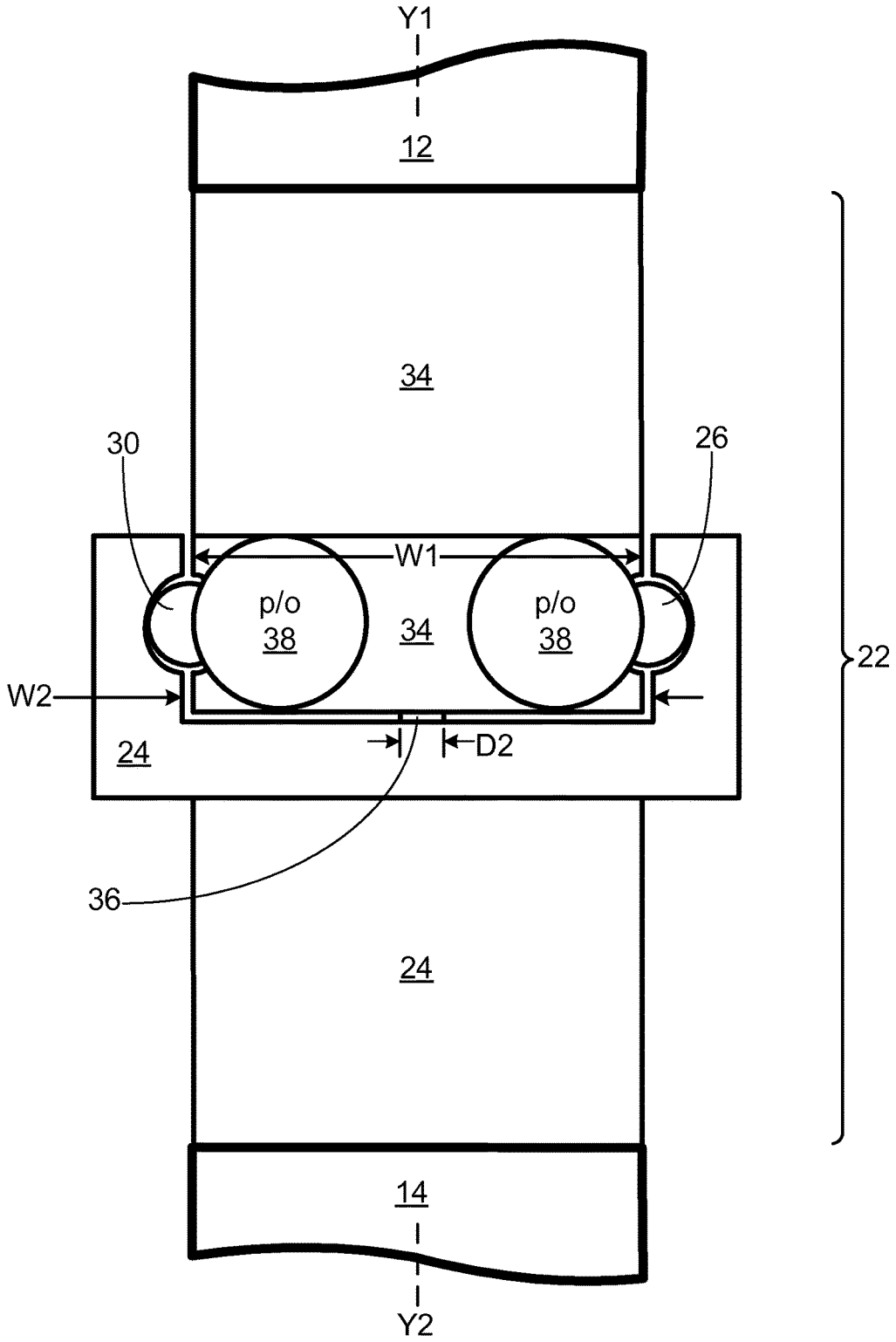
FIG. 4 is a diagram illustrating an enlarged plan view, in simplified form, of the slide mechanism of FIG. 2 rotated right 90 degrees.
Figure 5:
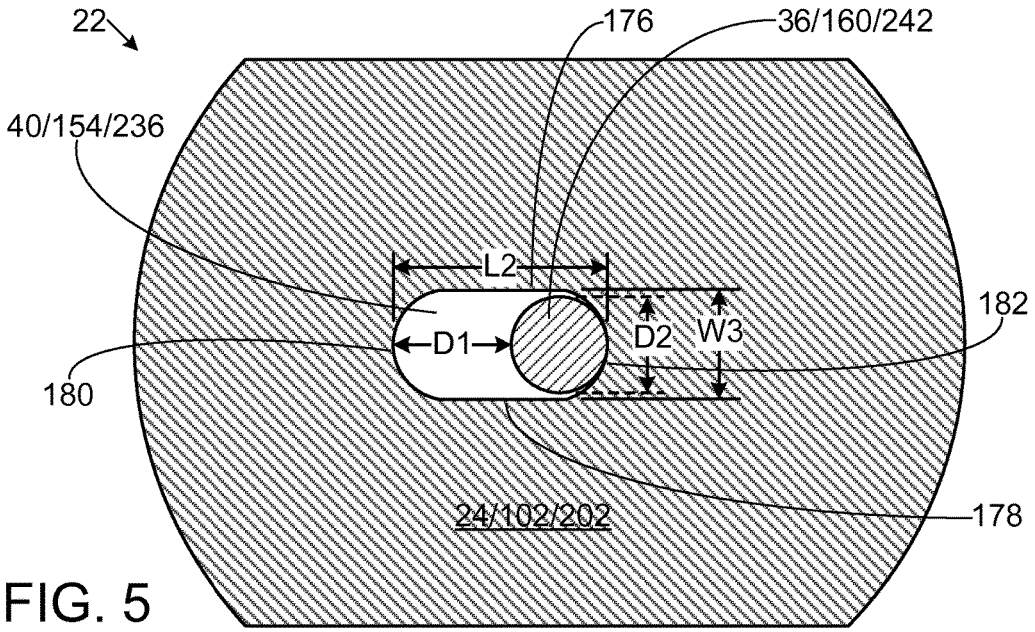
FIG. 5 is a diagram illustrating an enlarged cross-sectional view, in simplified form, of the slide mechanism of FIG. 2 taken along line C-C of FIG. 2.
Figure 6:
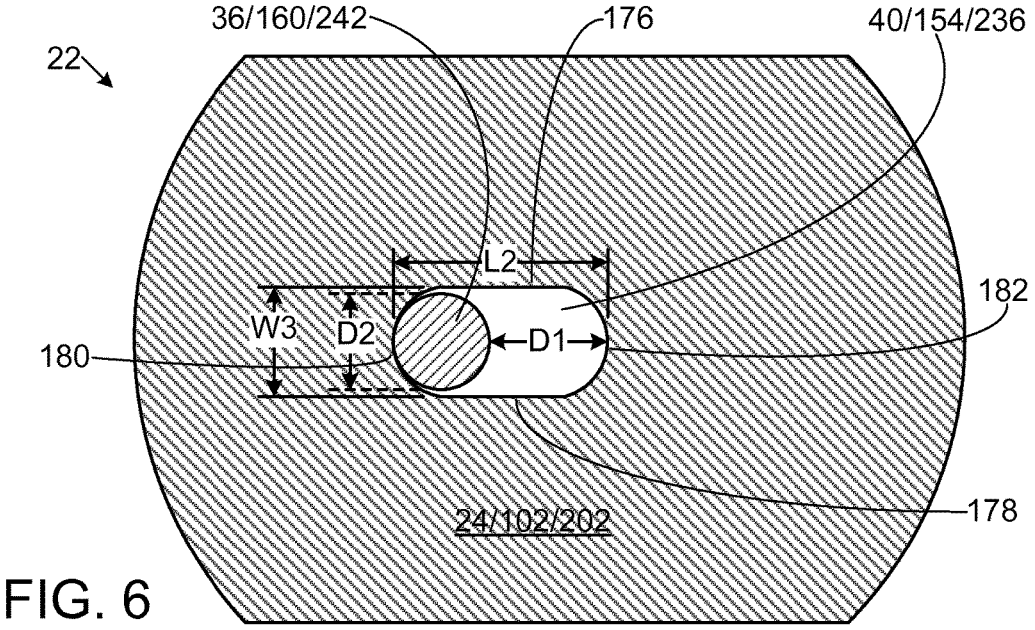
FIG. 6 is a diagram illustrating an enlarged cross-sectional view, in simplified form, of the slide mechanism of FIG. 3 taken along line D-D of FIG. 3.

FIG. 4 illustrates an enlarged plan view, in simplified form, of the slide mechanism 22 of FIG. 2 rotated right 90 degrees. A small portion of a post 36 of the aforementioned slide-limiting member that passes between the sliding rail member 34 and the rail guide 24 is shown in FIG. 4, whereas this post 36 was not visible in FIGS. 2 and 3. FIG. 5 illustrates an enlarged cross-sectional view, in simplified form, of the slide mechanism 22 of FIG. 2 taken along line C-C of FIG. 2. FIG. 6 illustrates an enlarged cross-sectional view, in simplified form, of the slide mechanism 22 of FIG. 3 taken along line D-D of FIG. 3. As exemplified in FIGS. 5 and 6, and referring again to FIG. 3, the rail guide 24 includes a rail travel distance limiting feature 40, and the bottom of the post 36 protrudes a prescribed protrusion distance into this distance limiting feature 40 after the slide mechanism 22 has been completely assembled. As will be described in more detail hereafter, the post 36 and the rail travel distance limiting feature 40 are cooperatively configured to limit the aforementioned transverse/lateral movement/shift of the lower end of the distal section 12 of the sports-related implement relative to the upper end of the proximal section 14 of the implement to the maximum rail travel distance D1.

Figure 7:
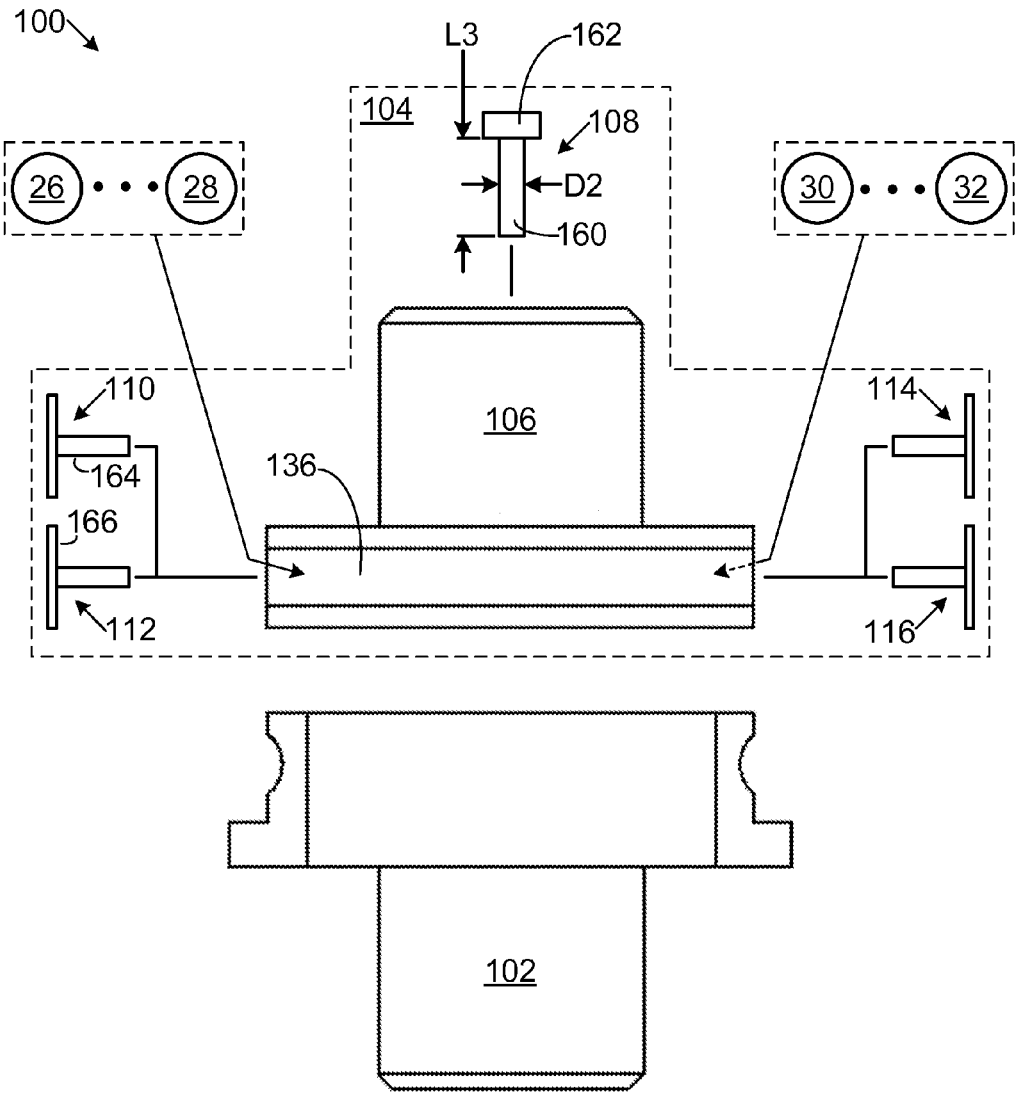
FIG. 7 is a diagram illustrating an exploded plan view, in simplified form, of a cavity-based embodiment of the slide mechanism of FIG. 2; this particular embodiment of the slide mechanism is hereafter simply referred to as the cavity-based slide mechanism.
Figure 16:
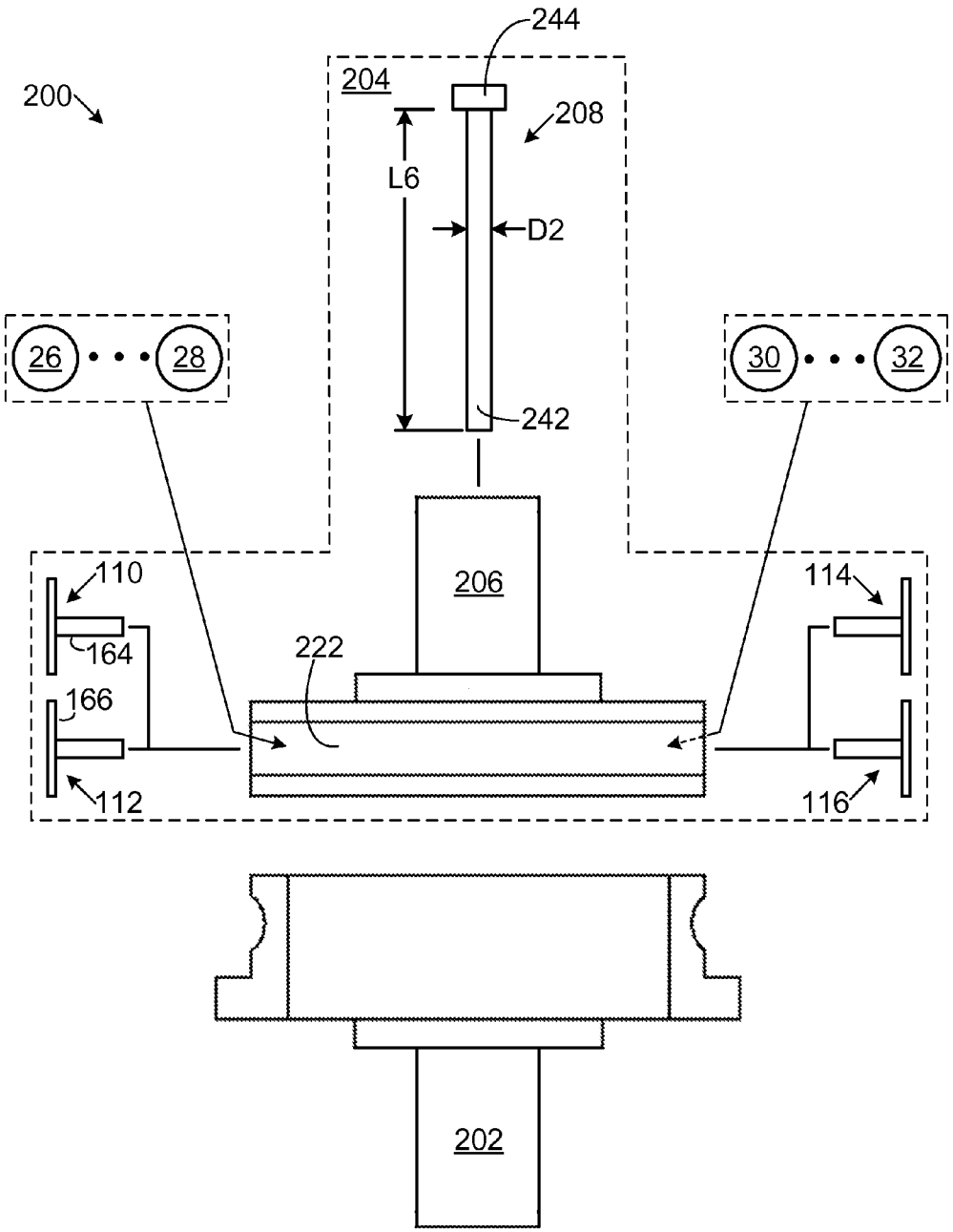
FIG. 16 is a diagram illustrating an exploded plan view, in simplified form, of a post-based embodiment of the slide mechanism of FIG. 2; this particular embodiment of the slide mechanism is hereafter simply referred to as the post-based slide mechanism.

FIG. 7 illustrates an exploded plan view, in simplified form, of a cavity-based embodiment of the slide mechanism 22 of FIG. 2; this particular embodiment of the slide mechanism 22 is hereafter simply referred to as the cavity-based slide mechanism 100. Referring again to FIG. 1 and as will be described in more detail hereafter, the cavity-based slide mechanism 100 is applicable to the situation where the sports-related implement 10 is golf club (among other types of sports-related implements). FIG. 16 illustrates an exploded plan view, in simplified form, of a post-based embodiment of the slide mechanism 22 of FIG. 2; this particular embodiment of the slide mechanism 22 is hereafter simply referred to as the post-based slide mechanism 200. The post-based slide mechanism 200 is applicable to the situation where the sports-related implement 10 is a baseball bat, or a tennis racket (among other types of sports-related implements).

The training apparatus embodiments described herein are advantageous for various reasons including, but not limited to, the following. As will be appreciated from FIGS. 1-7 and 16 and the more-detailed description of these FIGs. that follows, the design of the slide mechanism 22/100/200 minimizes the weight of the mechanism while maximizing its structural integrity (e.g., its mechanical strength), and provides strong mechanical resistance to bending and possible breakage during the swing 16 of the sports-related implement 10 with even the highest likely swing force and speed. As exemplified in FIGS. 2 and 3, after the slide mechanism 22/100/200 has been completely assembled and connected to the distal and proximal sections 12 and 14 of the implement 10, the slide mechanism 22/100/200 permits limited, low-friction, transverse/lateral movement of the lower end of the distal section 12 of the implement relative to the upper end of the proximal section 14 of the implement with substantial mechanical integrity. In other words, the rail guide 24/102/202, the plurality of front ball bearings (e.g., front ball bearings 26 and 28), the plurality of rear ball bearings (e.g., rear ball bearings 30 and 32), and the sliding rail assembly 104/204 of the slide mechanism 22/100/200 are cooperatively configured to permit low-friction, transverse/lateral movement (e.g., a transverse/lateral shift) of the lower end of the distal section 12 relative to the upper end of the proximal section 14 during a swinging 16 of the implement 10, where this movement/motion/shift is confined to a direction that is orthogonal to both the longitudinal axis Y1 of this lower end and the longitudinal axis Y2 of this upper end, and this movement/motion/shift is limited to the maximum rail travel distance D1.

1.1 Golf Club Application

The training apparatus embodiments described in this section are hereafter simply referred to as golf-club-related embodiments. These golf-club-related embodiments generally relate to the field of golf clubs and more particularly to a golf club swing training apparatus that golfers can use to improve the mechanics of how they swing their golf club (e.g., perfect their swing) and thus become better golfers. As is appreciated in the art of golf, golfers may employ the natural flexibility of a golf club shaft to shape a properly hit golf ball trajectory to selectively curve the ball either left-to-right or right-to-left. As will be appreciated from the more-detailed description that follows, the golf-club-related embodiments teach a golfer to swing a golf club in a manner that exploits the momentum of the head of the club to achieve the desired ball trajectory shape. In other words, the golf-club-related embodiments are specifically designed to help golfers learn to selectively control the shape of a golf ball's trajectory so that the ball is made to "bend" from right-to-left or left-to-right in a controlled manner.

Referring again to FIGS. 1-7, in the golf-club-related embodiments described in this section the sports-related implement 10 is a conventional golf club shaft having a butt end and a head end, the object 18 is a conventional golf ball, the distal section 12 of the implement is a lower shaft portion that includes the head end of the shaft, the proximal section 14 of the implement is an upper shaft portion that includes the butt end or grip of the shaft, and the slide mechanism 22 is the cavity-based slide mechanism 100. The golf-club-related embodiments are advantageous for various reasons including, but not limited to, the following. The golf-club-related embodiments can be used with any type of golf club (such as a driver club, among other types of golf clubs). The golf-club-related embodiments are also compatible with both a right-handed golf club that is swung 16 in a right-to-left manner, and a left-handed golf club that is swung 16 in a left-to-right manner.

Referring again to FIG. 7 and as will be appreciated from the more-detailed description of the golf-club-related embodiments that follows, after the cavity-based slide mechanism 100 has been completely assembled and inserted in-between the lower and upper shaft portions, the forces incurred during a golfer's successful use of the golf-club-related embodiments (that is, during a proper/preferred swing of the golf club for achieving the desired ball trajectory shape) may cause the aforementioned transverse/lateral movement/motion/shift of the upper end of the lower shaft portion relative to the lower end of the upper shaft portion, which may in turn cause the slide mechanism 100 to provide the golfer with both audible and tactile feedback indicating whether or not they have achieved a desired swing profile. More particularly, when the golfer swings their club in a manner that causes the transverse/lateral movement/motion/shift of the upper end of the lower shaft portion relative to the lower end of the upper shaft portion, the club's head is advanced toward the ball before impact by a distance that is greater than or equal to the aforementioned maximum rail travel distance D1, resulting in a right-to-left ball trajectory shape when the head face is square at ball impact. On the other hand, when the golfer swings their club in a manner that prevents such a movement/motion/shift, the upper end of the lower shaft portion and the lower end of the upper shaft portion remain coaxial and the head impacts the ball behind the shaft's axis, resulting in a left-to-right ball trajectory shape when the head face is square at ball impact. Thus, by practicing with the golf-club-related embodiments described in this section the golfer will learn how to control and alter their swing to produce a desired ball trajectory shape of either right-to-left or left-to-right. The audible and tactile feedback to the golfer that is generated when the movement/motion/shift occurs lets the golfer know whether and when this movement/motion/shift has occurred during their swing, and also allows the golfer to modify their swing mechanics to either produce this movement/motion/shift or prevent it in order to achieve the desired ball trajectory shape.

As exemplified in FIG. 7, the cavity-based slide mechanism 100 includes a cavity-based rail guide 102 (which represents one embodiment of the aforementioned rail guide 24), the aforementioned plurality of front ball bearings (e.g., front ball bearings 26 and 28), and the aforementioned plurality of rear ball bearings (e.g., rear ball bearings 30 and 32). The slide mechanism 100 also includes a cavity-based sliding rail assembly 104 that includes a cavity-based sliding rail member 106 (which represents one embodiment of the aforementioned sliding rail member 34), a cavity-based slide-limiting member 108 (which represents one embodiment of the slide-limiting member described in section 1.0), a pair of front ball bearing retainer members 110 and 114, and a pair of rear ball bearing retainer members 112 and 116. This collection of ball bearing retainer members 110/112/114/116 represents one embodiment of the aforementioned ball bearing retainer feature 38.

Figure 8:
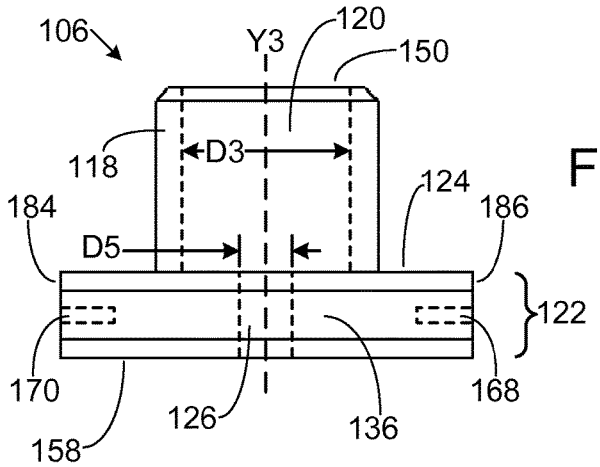
FIG. 8 is a diagram illustrating a standalone transparent plan view, in simplified form, of one embodiment of the cavity-based sliding rail member of the cavity-based slide mechanism of FIG. 7.
Figure 9:
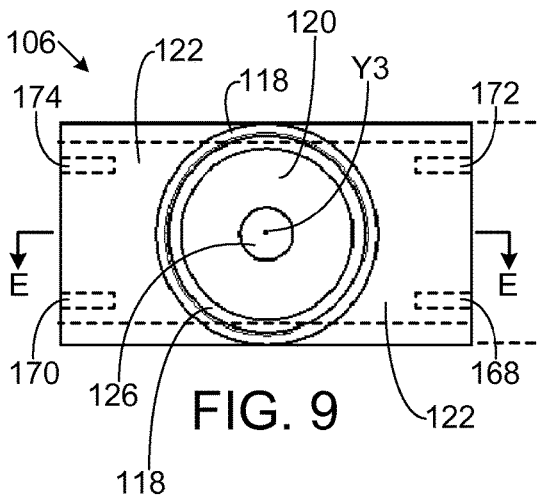
FIG. 9 is a diagram illustrating a transparent top view, in simplified form, of the cavity-based sliding rail member of FIG. 8.
Figure 10:
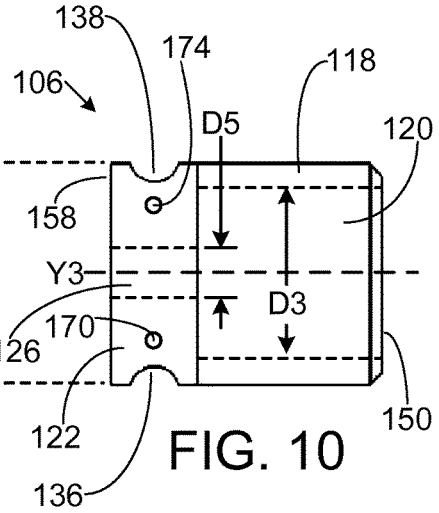
FIG. 10 is a diagram illustrating a transparent plan view, in simplified form, of the cavity-based sliding rail member of FIG. 9 rotated right 90 degrees.
Figure 11:
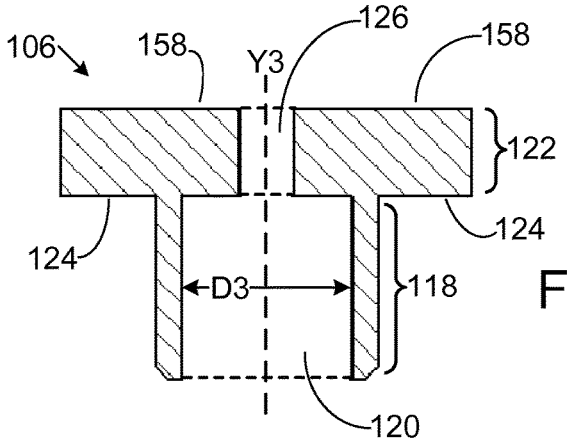
FIG. 11 is a diagram illustrating a cross-sectional view, in simplified form, of the cavity-based sliding rail member of FIG. 8 taken along line E-E of FIG. 9.
Figure 15:
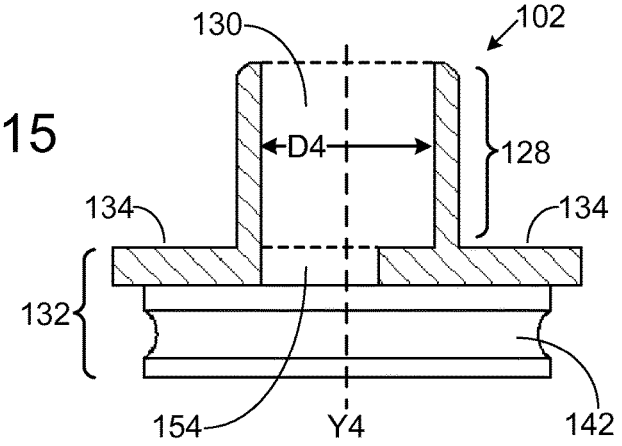
FIG. 15 is a diagram illustrating a cross-sectional view, in simplified form, of the cavity-based rail guide of FIG. 12 taken along line F-F of FIG. 13.
Figure 14:
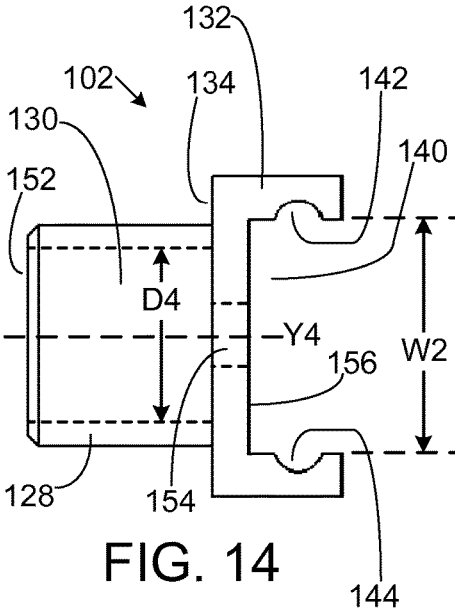
FIG. 14 is a diagram illustrating a transparent plan view, in simplified form, of the cavity-based rail guide of FIG. 13 rotated left 90 degrees.
Figure 13:
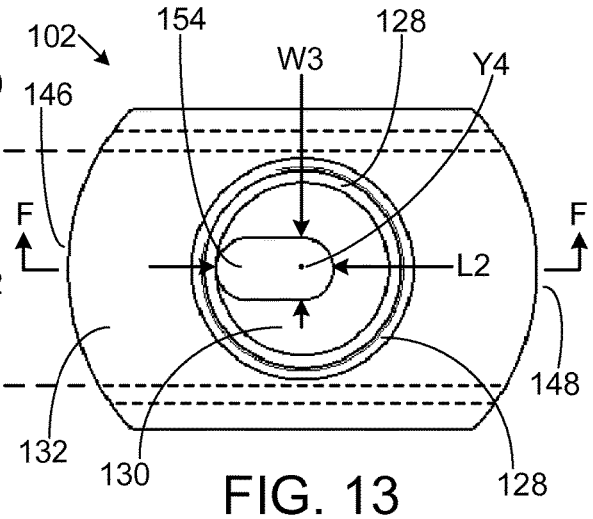
FIG. 13 is a diagram illustrating a transparent bottom view, in simplified form, of the cavity-based rail guide of FIG. 12.
Figure 12:
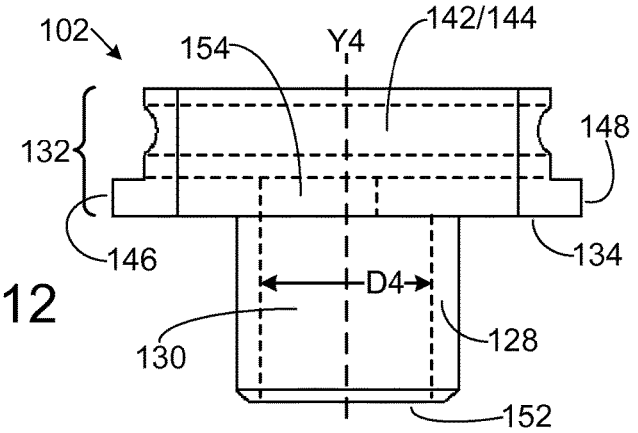
FIG. 12 is a diagram illustrating a standalone transparent plan view, in simplified form, of one embodiment of the cavity-based rail guide of the cavity-based slide mechanism of FIG. 7.

FIG. 8 illustrates a standalone transparent plan view, in simplified form, of one embodiment of the sliding rail member 106 of the slide mechanism 100 of FIG. 7. FIG. 9 illustrates a transparent top view, in simplified form, of the sliding rail member 106 of FIG. 8. FIG. 10 illustrates a transparent plan view, in simplified form, of the sliding rail member 106 of FIG. 9 rotated right 90 degrees. FIG. 11 illustrates a cross-sectional view, in simplified form, of the sliding rail member 106 taken along line E-E of FIG. 9. FIG. 12 illustrates a standalone transparent plan view, in simplified form, of one embodiment of the rail guide 102 of the slide mechanism 100 of FIG. 7. FIG. 13 illustrates a transparent bottom view, in simplified form, of the rail guide 102 of FIG. 12. FIG. 14 illustrates a transparent plan view, in simplified form, of the rail guide 102 of FIG. 13 rotated left 90 degrees. FIG. 15 illustrates a cross-sectional view, in simplified form, of the rail guide 102 of FIG. 12 taken along line F-F of FIG. 13.

As exemplified in FIGS. 8-11 and referring again to FIG. 7, the upper portion of the cavity-based sliding rail member 106 includes an upper connector 118 that is adapted to permit the upper end of the lower shaft portion to be securely connected to the top 150 of the connector 118 in a manner that insures this upper end is coaxial with the connector 118, and thus is coaxial with the cavity-based sliding rail assembly 104, regardless of how the club is swung. It is noted that this rigid connection can be realized in a variety of ways. By way of example but not limitation, in the cavity-based sliding rail member 106 embodiment that is shown in FIGS. 8-11 this adaptation is configured as follows. The top end 150 of the upper connector 118 includes a cylindrical cavity 120 that is coaxial with the connector 118. This cavity 120 has a diameter D3 that is sized to permit the upper end of the lower shaft portion to be snugly inserted downward into the cavity 120 while a strong adhesive is used to rigidly adhere the radial outer surface of this upper end to the radial wall of the cavity 120. It will be appreciated that various types of adhesive can be used. In an exemplary implementation of the cavity-based slide mechanism 100 the adhesive is an epoxy. The lower portion of the sliding rail member 106 includes a sliding rail block 122, where the bottom of the connector 118 is rigidly disposed onto a central position on the top surface 124 of the sliding rail block 122 such that the cavity 120 and the sliding rail block 122 have a common longitudinal axis Y3 which is orthogonal to the surface 124, thus insuring that the longitudinal axis of the upper end of the lower shaft portion is orthogonal to the surface 124 when this upper end is connected to the top of the connector 118.

As exemplified in FIGS. 12-15 and referring again to FIG. 7, the lower portion of the cavity-based rail guide 102 includes a lower connector 128 that is adapted to permit the lower end of the upper shaft portion to be securely connected to the bottom 152 of the connector 128 in a manner that insures this lower end is coaxial with the connector 128, and thus is coaxial with the rail guide 102, regardless of how the club is swung. It is noted that this rigid connection can be realized in a variety of ways. By way of example but not limitation, in the cavity-based rail guide 102 embodiment that is shown in FIGS. 12-15 this adaptation is configured as follows. The bottom end 152 of the lower connector 128 includes a cylindrical cavity 130 that is coaxial with the connector 128. This cavity 130 has a diameter D4 that is sized to permit the lower end of the upper shaft portion to be snugly inserted upward into the cavity 130 while the aforementioned strong adhesive is used to rigidly adhere the radial outer surface of this lower end to the radial wall of the cavity 130. It is noted that the diameter D4 is typically slightly larger than the diameter D3 since on a conventional golf club shaft the diameter of the lower end of the upper shaft portion is typically slightly larger than the diameter of the upper end of the lower shaft portion. The upper portion of the rail guide 102 includes a guide block 132, where the top of the connector 128 is rigidly disposed onto a central position on the bottom surface 134 of the guide block 132 such that the cavity 130 and the guide block 132 have a common longitudinal axis Y4 which is orthogonal to the surface 134, thus insuring that the longitudinal axis of the lower end of the upper shaft portion is orthogonal to the surface 134 when this lower end is connected to the bottom 152 of the connector 128.

Generally speaking and referring again to FIGS. 4 and 7-15, the cavity-based rail guide 102, the front ball bearings 26/28, the rear ball bearings 30/32, and the cavity-based sliding rail assembly 104 are cooperatively configured to permit low-friction, transverse/lateral movement (e.g., a transverse/lateral shift) of the assembly 104 relative to the guide 102, where this movement/shift is limited to the maximum rail travel distance D1. More particularly, the sliding rail block 122 of the cavity-based sliding rail member 106 has a prescribed width W1 and includes a pair of opposing elongated rail slots 136 and 138 (namely a front rail slot 136 and a rear rail slot 138). As exemplified in FIGS. 4 and 10, the rail slots 136 and 138 are positioned such that their longitudinal axes lie along a horizontal plane that is orthogonal to the longitudinal axis Y3 of the sliding rail member 106. The upper portion of the guide block 132 of the cavity-based rail guide 102 includes a linear guide channel 140 that passes from the left side 146 of the guide block 132 to the right side 148 thereof, where this channel 140 is generally adapted to receive the combination of the sliding rail block 122 and the front and rear ball bearings 26/28/30/32 in sliding engagement when this combination is slidably inserted into the channel 140. More particularly, the vertical axis of the linear guide channel 140 is aligned with the aforementioned common longitudinal axis Y4 of the rail guide 102. The guide channel 140 has parallel vertical sidewalls and a pair of opposing elongated guide slots 142 and 144 (namely a front guide slot 142 and a rear guide slot 144), where the front guide slot 142 resides on one of the sidewalls of the channel 140 and the rear guide slot 144 resides on the other of the sidewalls of the channel 140. As exemplified in FIGS. 4 and 14, the front and rear guide slots 142 and 144 are positioned on their respective sidewalls such that their longitudinal axes lie along a horizontal plane that is orthogonal to the longitudinal axis Y4. The guide channel 140 also has a prescribed width W2 that is slightly greater than width W1, thus allowing the sliding rail block 122 to be movably positioned within the channel 140. The front rail slot 136 and the front guide slot 142 have a common shape that is slightly less than semi-circular and is sized to allow these slots 136 and 142 to receive the front ball bearings 26/28 in low-friction rolling engagement when the sliding rail block 122 is positioned within the guide channel 140. The front ball bearings 26/28 thus serve to separate the front rail slot 136 and the front guide slot 142 slightly. In an exemplary embodiment of the cavity-based slide mechanism 100 the size and shape of the front rail slot 136 and the front guide slot 142 matches the size and shape of a portion of the exterior surface of each of the front ball bearings 26/28 so that the contact between each of the ball bearings 26/28 and the slots 136 and 142 is equally distributed over the entire surface of each of the ball bearings 26/28, thus minimizing the friction between these slots and ball bearings. Similarly, the rear rail slot 138 and the rear guide slot 144 have a common shape that is slightly less than semi-circular and is sized to allow these slots 138 and 144 to receive the rear ball bearings 30/32 in low-friction rolling engagement when the sliding rail block 122 is positioned within the guide channel 140. The rear ball bearings 30/32 thus serve to separate the rear rail slot 138 and the rear guide slot 144 slightly. In an exemplary embodiment of the slide mechanism 100 the size and shape of the rear rail slot 138 and the rear guide slot 144 matches the size and shape of a portion of the exterior surface of each of the rear ball bearings 30/32 so that the contact between each of the ball bearings 30/32 and the slots 138 and 144 is equally distributed over the entire surface of each of the ball bearings 30/32, thus minimizing the friction between these slots and ball bearings. Accordingly, once the sliding rail block 122 has been movably positioned within the guide channel 140, and the front ball bearings 26/28 have been rollably and slidably inserted in-between the front rail slot 136 and the front guide slot 142, and the rear ball bearings 30/32 have been rollably and slidably inserted in-between the rear rail slot 138 and the rear guide slot 144, the sliding rail member 106 (and thus the sliding rail assembly 104) is permitted to slide/travel in a direction that is orthogonal to both the longitudinal axis Y3 of the sliding rail member 106 (and thus the longitudinal axis of the sliding rail assembly 104) and the longitudinal axis Y4 of the rail guide 102.

Referring again to FIGS. 4, 7, 9, 10, 13 and 14, in an exemplary implementation of the cavity-based slide mechanism 100 the difference between the just-described widths W1 and W2 is greater than or equal to 1.0 millimeters and less than or equal to 2.0 millimeters. The cavity-based sliding rail member 106 can optionally include one or more weight-reducing apertures (not shown) that serve to further reduce the weight of the cavity-based slide mechanism 100, where these apertures may be sized to be as large as possible without negatively affecting the structural integrity of the sliding rail member 106. Similarly, the cavity-based rail guide 102 can optionally include one or more weight-reducing apertures (also not shown) that serve to yet further reduce the weight of the slide mechanism 100, where these apertures may be sized to be as large as possible without negatively affecting the structural integrity of the rail guide 102. The exterior edges and corners on the slide mechanism 100 can optionally be rounded in order to prevent injury to the golfer and yet further reduce the weight of the slide mechanism 100.

As exemplified in FIGS. 5, 6 and 12-15, the guide block 132 of the cavity-based rail guide 102 also includes a rail travel distance limiting aperture 154 that is located on the bottom surface 156 of the rail guide's guide channel 140. It is noted that this rail travel distance limiting aperture 154 represents one embodiment of the aforementioned rail travel distance limiting feature 40. The rail travel distance limiting aperture 154 has a prescribed width W3 and a prescribed length L2, and in an exemplary embodiment of the rail guide 102 passes between the cylindrical cavity 130 and the linear guide channel 140. As exemplified in FIGS. 8-11, the cavity-based sliding rail member 106 includes a longitudinal aperture 126 that passes from the cylindrical cavity 120 to the bottom 158 of the sliding rail member 106 (which is the bottom of the sliding rail block 122), where the longitudinal axis of this aperture 126 is aligned with the common longitudinal axis Y3 of both the cavity 120 and the sliding rail block 122. In other words, the aperture 126 is coaxial with both the upper connector 118 and the sliding rail block 122. The aperture 126 has a prescribed radially cross-sectional shape and a prescribed diameter D5. As exemplified in FIG. 7, the cavity-based slide-limiting member 108 that is securely inserted into the aperture 126 includes an aperture-mating post 160 (which represents one embodiment of the aforementioned post 36) and a head 162 that is rigidly disposed onto the top of the post 160. The post 160 has a radially cross-sectional shape that is the same as the radially cross-sectional shape of the aperture 126. The post 160 also has a prescribed length L3 and a prescribed diameter D2 that are selected to permit the post 160 to be fully and securely inserted downward into the aperture 126 so that the post 160 protrudes from the bottom 158 of the sliding rail member 106 after this insertion (a portion of this protrusion is shown in FIG. 4) and the bottom of the post 160 protrudes the aforementioned protrusion distance into the rail travel distance limiting aperture 154.

Referring again to FIGS. 7-11, in one implementation of the cavity-based slide mechanism 100 the longitudinal aperture 126 can have a circular radially cross-sectional shape and can be threaded, and the radially outer surface of the aperture-mating post 160 can also be threaded in a manner that permits the post 160 to be threadably connected to the aperture 126, thus allowing the secure insertion of the cavity-based slide-limiting member 108 into the cavity-based sliding rail member 106 to be made by threadably fully inserting the post 160 into the aperture 126. In this particular implementation a lock-washer (not shown) can optionally be disposed onto the post 160 before it is threadably inserted into the aperture 126; when the post 160 is threadably fully inserted into the aperture 126 the lock-washer will become sandwiched between the bottom of the head 162 and the bottom of the cylindrical cavity 120. In another implementation of the slide mechanism 100 where the aperture 126 is un-threaded and the radially outer surface of the post 160 is un-threaded, the aperture 126 can have any one of a variety of radially cross-sectional shapes (e.g., a circle, a square, and a hexagon, among other two-dimensional shapes) and the secure insertion of the slide-limiting member 108 into the sliding rail member 106 can be made by inserting the post 160 into the aperture 126 while the aforementioned strong adhesive is used to rigidly adhere the radially outer surface of the post 160 to the radial wall of the aperture 126.

Referring again to FIGS. 2-15, the ball bearing retainer feature 38 is generally adapted to retain the front ball bearings 26/28 in-between the front rail slot 136 and the front guide slot 142, and also retain the rear ball bearings 30/32 in-between the rear rail slot 138 and the rear guide slot 144, when the sliding rail block 122 of the cavity-based sliding rail member 106 is movably positioned within the guide channel 140 of the cavity-based rail guide 102. It is noted that the ball bearing retainer feature 38 can be realized in a variety of ways. By way of example but not limitation, in the cavity-based sliding rail assembly 104 embodiment that is shown in FIGS. 2-4 and 7-10 the ball bearing retainer feature 38 is realized as follows. The ball bearing retainer feature includes the aforementioned front ball bearing retainer members 110 and 114 and rear ball bearing retainer members 112 and 116. Each of these retainer members 110/112/114/116 includes a post (e.g., post 164) and a head (e.g., head 166) that is rigidly disposed onto one end of the post. The sliding rail block 122 includes a pair of front retainer member cavities 168 and 170, and a pair of rear retainer member cavities 172 and 174, where the longitudinal axis of each of these cavities 168/170/172/174 lies along the aforementioned horizontal plane along which the rail slots 136 and 138 are positioned (as shown in FIGS. 8 and 10), and each of these cavities 168/170/172/174 has a size and shape that are adapted to allow the post (e.g., post 164) of a given one of the retainer members 110/112/114/116 to be fully and securely inserted into the cavity such that the head (e.g., head 166) of this retainer member contacts the left side 184 or the right side 186 of the sliding rail block 122 (as shown in FIGS. 2-4). In one implementation of the sliding rail assembly 104 each of the cavities 168/170/172/174 can have a circular radially cross-sectional shape and can be threaded, and the radially outer surface of the post of each of the retainer members 110/112/114/116 can also be threaded in a manner that permits it to be threadably connected to a given one of the cavities 168/170/172/174. As shown in FIGS. 3 and 4, the head of each of the retainer members 110/112/114/116 has a radial size that is selected to allow this head to cover a prescribed portion of a given one of the ends of a given one of the rail slots 136/138, where this portion is large enough to prevent the ball bearings 26/28/30/32 from falling out of the slide mechanism 100 after it has been completely assembled regardless of how the golf club is swung, and small enough to allow the aforementioned transverse/lateral movement of the assembly 104 relative to the guide 102 (e.g., the front ball bearing retainer members 110 and 114 retain the front ball bearings 26/28 in-between the front rail slot 136 and the front guide slot 142, and the rear ball bearing retainer members 112 and 116 retain the rear ball bearings 30/32 in-between the rear rail slot 138 and the rear guide slot 144).

As will be appreciated from FIGS. 4-6 and the functional operation of the cavity-based slide mechanism 100 described in this section, and referring again to FIGS. 7-15, after the cavity-based slide mechanism 100 has been completely assembled, the length L3 of the aperture-mating post 160 of the cavity-based slide-limiting member 108 is selected such that the bottom of this post 160 will protrude the aforementioned protrusion distance into the rail travel distance limiting aperture 154 on the cavity-based rail guide 102. As will now be described in more detail, this aperture 154 is adapted to limit the travel of the cavity-based sliding rail assembly 104 (e.g., limit the aforementioned transverse/lateral movement/motion/shift) to the maximum rail travel distance D1 by limiting the travel of the post 160 to this distance D1. More particularly, the aperture 154 has one pair of opposing vertical sidewalls 176 and 178 that are parallel to each other and to the vertical sidewalls of the rail guide's linear guide channel 140. The aperture 154 has another pair of opposing vertical sidewalls 180 and 182 that are symmetrical to each other, where a horizontally central portion of both of these sidewalls 180 and 182 is orthogonal to the direction of slide/travel of the cavity-based sliding rail member 106, and thus the direction of slide/travel of the post 160 of the slide-limiting member 108. As exemplified in FIGS. 5 and 6, both the width W3 and length L2 of the aperture 154 are greater than the diameter D2 of the post 160, thus permitting the post 160 to travel laterally (e.g., leftward and rightward from the perspective of FIGS. 2, 3, 5 and 6) within the aperture 154. As will be appreciated from FIGS. 5 and 6, the difference between the length L2 and the diameter D2 defines the distance D1. When the sliding rail assembly 104 is situated in the aforementioned coaxial position on the rail guide 102 the right side of the post 160 makes contact with the sidewall 182 as shown in FIG. 5. When the sliding rail assembly 104 is situated in the aforementioned maximally non-coaxial position on the rail guide 102 (which in the illustrated case is a leftmost position) the left side of the post 160 makes contact with the sidewall 180 as shown in FIG. 6. Generally speaking, the length L2 and the diameter D2 can be selected so that the distance D1 can have any value, where this value is selected based on the stiffness of the golf club, among other factors. By way of example but not limitation, in an exemplary embodiment of the slide mechanism 100 the length L2 and the diameter D2 are selected so that the distance D1 is approximately 0.65 millimeters.

Given the foregoing and referring again to FIGS. 5-7, it will be appreciated that the cavity-based slide mechanism 100 permits the golfer to hear and feel the transverse/lateral movement/motion/shift of the upper end of the lower shaft portion relative to the lower end of the upper shaft portion when the golfer swings the club in a desired manner. In other words, when the slide mechanism 100 is interposed into the club's shaft as described herein, the slide mechanism 100 provides the golfer with the aforementioned audible and tactile feedback indicating whether or not they have achieved a desired swing profile. For example, when the club is swung in a manner that makes the upper end of the lower shaft portion transversely/laterally move/shift leftward relative to the lower end of the upper shaft portion such that the cavity-based sliding rail assembly 104 reaches the maximally non-coaxial position on the cavity-based rail guide 102 and the left side of the aperture-mating post 160 impacts the vertical sidewall 180 of the rail travel distance limiting aperture 154, the slide mechanism 100 will generate a discernible sound (e.g., the golfer will hear a "click" sound) and will also generate a tactile sensation at the proximal end of the club (e.g., the golfer will feel a vibration that travels from the mechanism 100 through the upper shaft portion and into their hands).

It will also be appreciated that the cavity-based slide mechanism can be interposed into the golf club shaft at any desired location along the shaft. The decision of which location along the shaft the aforementioned cut is to be made and the slide mechanism is to be interposed involves the consideration of various factors such as the following. Locating the slide mechanism closer to the grip on the butt end of the shaft maximizes the flex in the lower shaft portion when the club is swung which is advantageous. However, the inherent weight of the slide mechanism can also change the balance point of the club which is disadvantageous, where the degree of this change depends on the actual weight of the slide mechanism and the particular location along the shaft where the slide mechanism is interposed. In an exemplary implementation of the golf-club-related embodiments described in this section where the golf club is a driver club having a graphite shaft and an over length of approximately 45 inches, the aforementioned gap into which the slide mechanism is inserted is located at a distance from the butt end of the shaft of about 30 percent of the total length of the club (including the head of the club).

Figure 26:
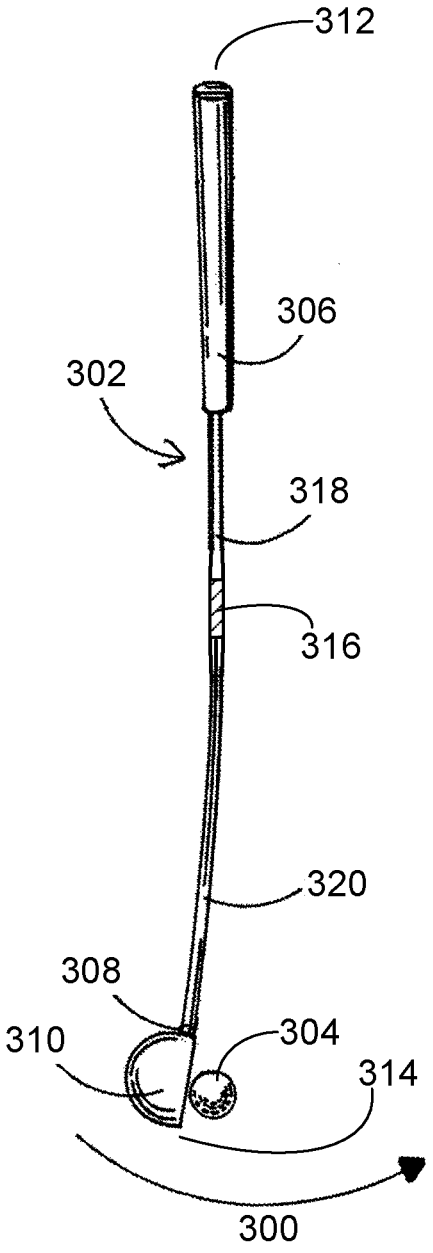
FIG. 26 is a diagram illustrating a plan view, in simplified form, of an exemplary embodiment of a conventional golf club and a conventional golf ball, where a person swings the club in an attempt to hit the golf ball.

FIG. 26 illustrates a plan view, in simplified form, of an exemplary embodiment of the aforementioned conventional golf club and golf ball. As exemplified in FIG. 26 and referring again to FIG. 7, a person swings 300 the golf club 302 in an attempt to hit the golf ball 304. The club 302 has a shaft 306 connected by a hosel 308 to a head 310. The golf club shaft 306 has a butt end 312 and a head end 314. The club shaft 306 includes two separate and distinct portions that are spaced apart to form a gap 316 there-between, namely an upper shaft portion 318 that includes the butt end 312, and a lower shaft portion 320 that includes the head end 314. The cavity-based slide mechanism 100 is inserted within the gap 316, and is connected to the lower end of the upper shaft portion 318 and the upper end of the lower shaft portion 320 as described heretofore.

1.2 Baseball Bat Application

The training apparatus embodiments described in this section are hereafter simply referred to as baseball-bat-related embodiments. These baseball-bat-related embodiments generally relate to the field of baseball bats and more particularly to a baseball bat swing training apparatus that batters can use to improve the mechanics of how they swing their bat (e.g., perfect their swing) and thus become better hitters (e.g., increase the speed of their swing and the frequency of getting a hit while they are at bat). In other words and as will be appreciated from the more-detailed description that follows, the baseball-bat-related embodiments teach a batter to swing a bat faster (e.g., increase their bat speed and power), thus enabling the batter to hit a baseball that is thrown to them harder and further more consistently.

Referring again to FIGS. 1-6 and 16, in the baseball-bat-related embodiments described in this section the sports-related implement 10 is a conventional baseball bat, the object 18 is a conventional baseball, the distal section 12 of the implement is a barrel section of the bat, the proximal section 14 of the implement is a handle section of the bat, and the slide mechanism 22 is the post-based slide mechanism 200. The baseball-bat-related embodiments are advantageous for various reasons including, but not limited to, the following. The baseball-bat-related embodiments can be used with any type of baseball bat including, but not limited to, a conventional wood bat, or a conventional metal bat, or a conventional composite bat, or a conventional hybrid bat. As is appreciated in the sport of baseball, wood bats are more flexible than metal bats, and are also generally more flexible than composite and hybrid bats. A batter who has good swing mechanics is able to cause a wood bat to flex when it is swung. This flexing generally occurs midway between the proximal and distal ends of the bat and further increases the speed/power of the barrel section. Given the foregoing, it will be appreciated that when the slide mechanism 200 is interposed into a metal bat, or a composite bat, or a hybrid bad, the slide mechanism 200 allows the metal/composite/hybrid bat to simulate a wood bat.

Referring again to FIG. 16 and as will be appreciated from the more-detailed description of the baseball-bat-related embodiments that follows, after the post-based slide mechanism 200 has been completely assembled and inserted in-between the barrel section of the baseball bat and the handle section of the bat, the forces incurred during a batter's successful use of the baseball-bat-related embodiments (that is, during a proper/preferred swing of the bat) may cause the aforementioned transverse/lateral movement/motion/shift of the lower end of the barrel section relative to the upper end of the handle section, which may in turn cause the slide mechanism 200 to provide the batter with both audible and tactile feedback indicating whether or not they have achieved a desired swing profile. This audible and tactile feedback is advantageous since it realistically simulates the bat impacting a baseball. Thus, by practicing with the baseball-bat-related embodiments described in this section the batter will learn how to increase their bat speed and power.

Additionally, as is appreciated in the art of baseball, batters often warm up just before stepping into the batter's box. A given batter may perform this warm-up in a variety of ways including the following. The batter may warm-up by swinging a baseball bat this is significantly heavier than the bat they are going to use in the batter's box. The batter may also warm up by swinging a combination of conventional bats, which also increases the weight compared to the bat they are going to use in the batter's box. The batter may also slip a conventional weighted donut ring onto their bat and then warm-up by swinging this temporarily weighted bat. The baseball-bat-related embodiments described in this section are further advantageous in that they can be used by a batter as a warm-up device. More particularly, in an exemplary warm-up implementation of the baseball-bat-related embodiments the batter can slip the conventional weighted donut ring onto the barrel section of the bat after the post-based slide mechanism has been completely assembled and inserted in-between the barrel and handle sections of the bat. Then, when the batter swings this warm-up implementation, the just-described audible and tactile feedback that is provided to the batter when the just-described transverse/lateral movement/motion/shift occurs will provide the batter with the sensation of hitting a ball.

As exemplified in FIG. 16, the post-based slide mechanism 200 includes a post-based rail guide 202 (which represents another embodiment of the aforementioned rail guide 24), the aforementioned plurality of front ball bearings (e.g., front ball bearings 26 and 28), and the aforementioned plurality of rear ball bearings (e.g., rear ball bearings 30 and 32). The slide mechanism 200 also includes a post-based sliding rail assembly 204 that includes a post-based sliding rail member 206 (which represents another embodiment of the aforementioned sliding rail member 34), a post-based slide-limiting member 208 (which represents another embodiment of the slide-limiting member described in section 1.0), the aforementioned pair of front ball bearing retainer members 110 and 114, and the aforementioned pair of rear ball bearing retainer members 112 and 116. As described heretofore, this collection of ball bearing retainer members 110/112/114/116 represents one embodiment of the aforementioned ball bearing retainer feature 38).

Figure 17:
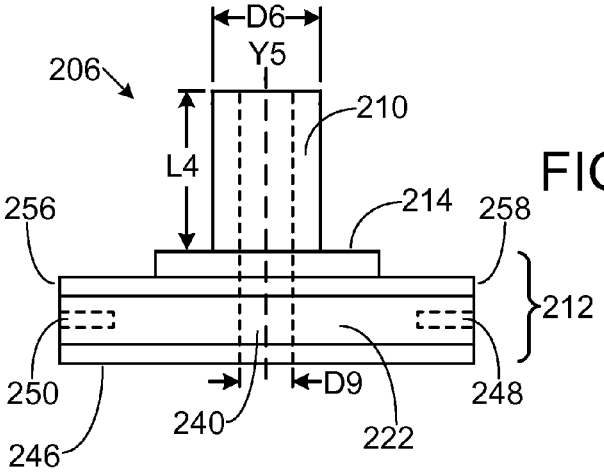
FIG. 17 is a diagram illustrating a standalone transparent plan view, in simplified form, of an exemplary embodiment of the post-based sliding rail member of the post-based slide mechanism of FIG. 16.
Figure 18:
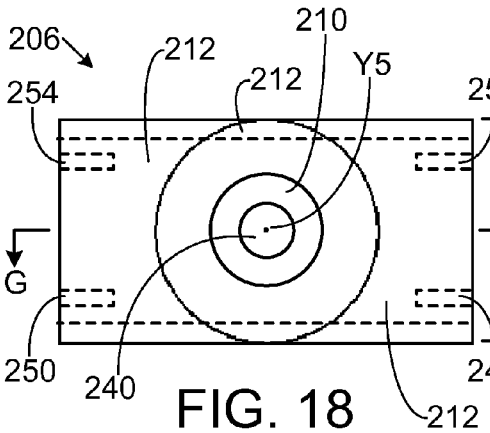
FIG. 18 is a diagram illustrating a transparent top view, in simplified form, of the post-based sliding rail member of FIG. 17.
Figure 19:
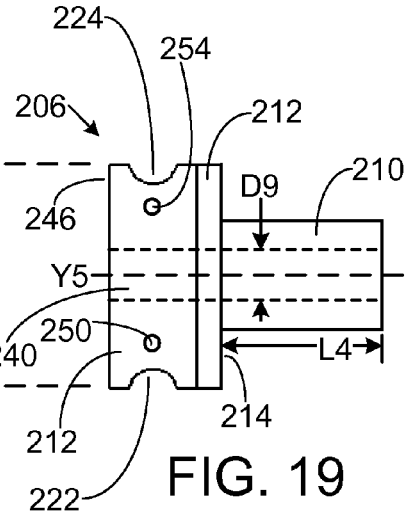
FIG. 19 is a diagram illustrating a transparent plan view, in simplified form, of the post-based sliding rail member of FIG. 18 rotated right 90 degrees.
Figure 20:
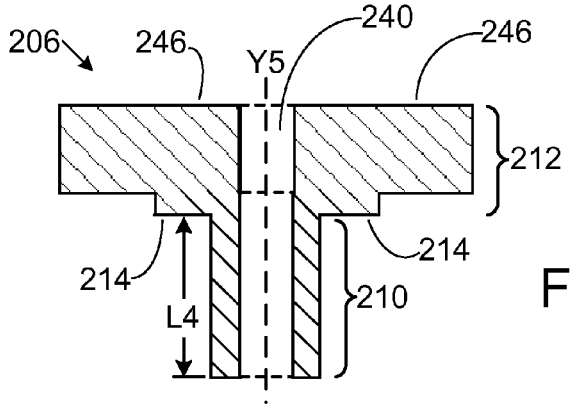
FIG. 20 is a diagram illustrating a cross-sectional view, in simplified form, of the post-based sliding rail member of FIG. 17 taken along line G-G of FIG. 18.

FIG. 17 illustrates a standalone transparent plan view, in simplified form, of an exemplary embodiment of the sliding rail member 206 of the slide mechanism 200 of FIG. 16. FIG. 18 illustrates a transparent top view, in simplified form, of the sliding rail member 206 of FIG. 17. FIG. 19 illustrates a transparent plan view, in simplified form, of the sliding rail member 206 of FIG. 18 rotated right 90 degrees. FIG. 20 illustrates a cross-sectional view, in simplified form, of the sliding rail member 206 taken along line G-G of FIG. 18. FIG. 21 illustrates a standalone transparent plan view, in simplified form, of an exemplary embodiment of the rail guide 202 of the slide mechanism 200 of FIG. 16. FIG. 22 illustrates a transparent bottom view, in simplified form, of the rail guide 202 of FIG. 21. FIG. 23 illustrates a transparent plan view, in simplified form, of the rail guide 202 of FIG. 22 rotated left 90 degrees. FIG. 24 illustrates a cross-sectional view, in simplified form, of the rail guide 202 of FIG. 21 taken along line H-H of FIG. 22.

As exemplified in FIGS. 17-20 and referring again to FIG. 16, the upper portion of the post-based sliding rail member 206 is adapted to permit the lower end of the barrel section of the bat to be securely connected to this upper portion in a manner that insures this lower end is coaxial with the post-based sliding rail assembly 204 regardless of how the bat is swung. It is noted that this secure connection can be realized in a variety of ways. By way of example but not limitation, in the post-based sliding rail member 206 embodiment that is shown in FIGS. 17-20 this adaptation is configured as follows. The upper portion of the sliding rail member 206 includes a barrel-mating post 210 and the lower portion of the sliding rail member 206 includes a sliding rail block 212, where the bottom of the post 210 is rigidly disposed onto a central position on the top surface 214 of the sliding rail block 212 such that the post 210 and the sliding rail block 212 have a common longitudinal axis Y5 which is orthogonal to the surface 214, thus insuring that the longitudinal axis of the lower end of the barrel section is orthogonal to the surface 214, and insuring that the bottom surface of the barrel section is flush with the surface 214, when this lower end is connected to the sliding rail member 206.

Referring again to FIGS. 17-20, the barrel-mating post 210 has a radially cross-sectional shape that is the same as the radially cross-sectional shape of a longitudinal cavity that is formed on the lower end of the barrel section of the bat, where the longitudinal axis of this cavity is aligned with the longitudinal axis of the lower end of the barrel section. The barrel-mating post 210 also has a prescribed length L4 and a prescribed diameter D6 that are selected to permit the post 210 to be fully and snugly inserted upward into the longitudinal cavity. In one embodiment of the baseball bat swing training apparatus described in this section where the bat has a solid longitudinal interior (which is generally the case for wood bats), the longitudinal cavity can be formed on the lower end of the barrel section after the bat is cut and the aforementioned longitudinal section is removed. In one implementation of this particular embodiment the longitudinal cavity can have a circular radially cross-sectional shape and the radially outer surface of the barrel-mating post 210 can be threaded, thus allowing the secure connection of the lower end of the barrel section to the post-based sliding rail member 206 to be made by threadably inserting the post 210 into the cavity. In one version of this particular implementation the threads on the barrel-mating post 210 are formed in a counterclockwise arrangement, which is advantageous since it results in the connection between the lower end the barrel section and the sliding rail member 206 remaining tight/secure when the bat is swung by a right-handed batter. In another version of this particular implementation the threads on the barrel-mating post 210 are formed in a clockwise arrangement, which is advantageous since it results in the connection between the lower end the barrel section and the sliding rail member 206 remaining tight/secure when the bat is swung by a left-handed batter. In another implementation of this particular embodiment where the radially outer surface of the barrel-mating post 210 is un-threaded (e.g., smooth), the longitudinal cavity can have any one of a variety of radially cross-sectional shapes (e.g., a circle, a square, a hexagon, and a triangle, among other two-dimensional shapes) and the secure connection of the lower end of the barrel section to the sliding rail member 206 can be made by inserting the post 210 into the cavity while the aforementioned strong adhesive is used to rigidly adhere the radially outer surface of the post 210 to the radial wall of the cavity. In another embodiment of the baseball bat swing training apparatus where the bat has a hollow longitudinal interior (which is generally the case for metal bats and most composite bats), a longitudinal cavity having a circular radially cross-sectional shape naturally exists on the lower end of the barrel section, where the longitudinal axis of this cavity is aligned with the longitudinal axis of the lower end of the barrel section. In an exemplary implementation of this particular embodiment the radially outer surface of the barrel-mating post 210 is un-threaded and the secure connection of lower end of the barrel section to the sliding rail member 206 is made by inserting the post 210 into the longitudinal cavity while the strong adhesive is used to rigidly adhere the radially outer surface of the post 210 to the radial wall of the cavity.

As exemplified in FIGS. 21-24 and referring again to FIG. 16, the lower portion of the post-based rail guide 202 is adapted to permit the upper end of the handle section of the bat to be securely connected to this lower portion in a manner that insures this upper end is coaxial with the rail guide 202 regardless of how the bat is swung. It is noted that this secure connection can be realized in a variety of ways. By way of example but not limitation, in the post-based rail guide 202 embodiment that is shown in FIGS. 21-24 this adaptation is configured as follows. The lower portion of the rail guide 202 includes a handle-mating post 216 and the upper portion of the rail guide 202 includes a guide block 218, where the top of the post 216 is rigidly disposed onto a central position on the bottom surface 220 of the guide block 218 such that the post 216 and the guide block 218 have a common longitudinal axis Y6 which is orthogonal to the surface 220, thus insuring that the longitudinal axis of the upper end of the handle section is orthogonal to the surface 220, and insuring that the top surface of the handle section is flush with the surface 220, when this upper end is connected to the rail guide 202.

Referring again to FIGS. 17-20, the handle-mating post 216 has a radially cross-sectional shape that is the same as the radially cross-sectional shape of a longitudinal cavity that is formed on the upper end of the handle section of the bat, where the longitudinal axis of this cavity is aligned with the longitudinal axis of the upper end of the handle section. The handle-mating post 216 also has a prescribed length L5 and a prescribed diameter D7 that are selected to permit the post 216 to be fully and snugly inserted downward into the longitudinal cavity. In the aforementioned embodiment of the baseball bat swing training apparatus described in this section where the bat has a solid longitudinal interior, the longitudinal cavity can be formed on the upper end of the handle section after the bat is cut and the aforementioned longitudinal section is removed. In one implementation of this particular embodiment the longitudinal cavity can have a circular radially cross-sectional shape and the radially outer surface of the handle-mating post 216 can be threaded, thus allowing the secure connection of the upper end of the handle section to the post-based rail guide 202 to be made by threadably inserting the post 216 into the cavity. In one version of this particular implementation the threads on the handle-mating post 216 are formed in a counterclockwise arrangement, which is advantageous since it results in the connection between the upper end the handle section and the rail guide 202 remaining tight/secure when the bat is swung by a right-handed batter. In another version of this particular implementation the threads on the handle-mating post 216 are formed in a clockwise arrangement, which is advantageous since it results in the connection between the upper end the handle section and the rail guide 202 remaining tight/secure when the bat is swung by a left-handed batter. In another implementation of this particular embodiment where the radially outer surface of the handle-mating post 216 is un-threaded (e.g., smooth), the longitudinal cavity can have any one of a variety of radially cross-sectional shapes (e.g., a circle, a square, a hexagon, and a triangle, among other two-dimensional shapes) and the secure connection of the upper end of the handle section to the rail guide 202 can be made by inserting the post 216 into the cavity while the aforementioned strong adhesive is used to rigidly adhere the radially outer surface of the post 216 to the radial wall of the cavity. In the aforementioned other embodiment of the baseball bat swing training apparatus where the bat has a hollow longitudinal interior, a longitudinal cavity having a circular radially cross-sectional shape naturally exists on the upper end of the handle section, where the longitudinal axis of this cavity is aligned with the longitudinal axis of the upper end of the handle section. In an exemplary implementation of this particular embodiment the radially outer surface of the handle-mating post 216 is un-threaded and the secure connection of upper end of the handle section to the rail guide 202 is made by inserting the post 216 into the longitudinal cavity while the strong adhesive is used to rigidly adhere the radially outer surface of the post 216 to the radial wall of the cavity.

Generally speaking and referring again to FIGS. 4 and 16-24, the post-based rail guide 202, the front ball bearings 26/28, the rear ball bearings 30/32, and the post-based sliding rail assembly 204 are cooperatively configured to permit low-friction, transverse/lateral movement (e.g., a transverse/lateral shift) of the assembly 204 relative to the guide 202, where this movement/shift is limited to the aforementioned maximum rail travel distance D1. More particularly, the sliding rail block 212 of the post-based sliding rail member 206 has the aforementioned width W1 and includes a pair of opposing elongated rail slots 222 and 224 (namely a front rail slot 222 and a rear rail slot 224). As exemplified in FIGS. 4 and 19, the rail slots 222 and 224 are positioned such that their longitudinal axes lie along a horizontal plane that is orthogonal to the longitudinal axis Y5 of the sliding rail member 206. The upper portion of the guide block 218 of the post-based rail guide 202 includes a linear guide channel 226 that passes from the left side 228 of the guide block 218 to the right side 230 thereof, where this channel 226 is generally adapted to receive the combination of the sliding rail block 212 and the front and rear ball bearings 26/28/30/32 in sliding engagement when this combination is slidably inserted into the channel 226. More particularly, the vertical axis of the linear guide channel 226 is aligned with the aforementioned common longitudinal axis Y6 of the rail guide 202. The guide channel 226 has parallel vertical sidewalls and a pair of opposing elongated guide slots 232 and 234 (namely a front guide slot 232 and a rear guide slot 234), where the front guide slot 232 resides on one of the sidewalls of the channel 226 and the rear guide slot 234 resides on the other of the sidewalls of the channel 226. As exemplified in FIGS. 4 and 23, the front and rear guide slots 232 and 234 are positioned on their respective sidewalls such that their longitudinal axes lie along a horizontal plane that is orthogonal to the longitudinal axis Y6. The guide channel 226 also has the aforementioned width W2 that is slightly greater than width W1, thus allowing the sliding rail block 212 to be movably positioned within the channel 226. The front rail slot 222 and the front guide slot 232 have a common shape that is slightly less than semi-circular and is sized to allow these slots 222 and 232 to receive the front ball bearings 26/28 in low-friction rolling engagement when the sliding rail block 212 is positioned within the guide channel 226. The front ball bearings 26/28 thus serve to separate the front rail slot 222 and the front guide slot 232 slightly. In an exemplary embodiment of the post-based slide mechanism 200 the size and shape of the front rail slot 222 and the front guide slot 232 matches the size and shape of a portion of the exterior surface of each of the front ball bearings 26/28 so that the contact between each of the ball bearings 26/28 and the slots 222 and 232 is equally distributed over the entire surface of each of the ball bearings 26/28, thus minimizing the friction between these slots and ball bearings. Similarly, the rear rail slot 224 and the rear guide slot 234 have a common shape that is slightly less than semi-circular and is sized to allow these slots 224 and 234 to receive the rear ball bearings 30/32 in low-friction rolling engagement when the sliding rail block 212 is positioned within the guide channel 226. The rear ball bearings 30/32 thus serve to separate the rear rail slot 224 and the rear guide slot 234 slightly. In an exemplary embodiment of the slide mechanism 200 the size and shape of the rear rail slot 224 and the rear guide slot 234 matches the size and shape of a portion of the exterior surface of each of the rear ball bearings 30/32 so that the contact between each of the ball bearings 30/32 and the slots 224 and 234 is equally distributed over the entire surface of each of the ball bearings 30/32, thus minimizing the friction between these slots and ball bearings. Accordingly, once the sliding rail block 212 has been movably positioned within the guide channel 226, and the front ball bearings 26/28 have been rollably and slidably inserted in-between the front rail slot 222 and the front guide slot 232, and the rear ball bearings 30/32 have been rollably and slidably inserted in-between the rear rail slot 224 and the rear guide slot 234, the sliding rail member 206 (and thus the sliding rail assembly 204) is permitted to slide/travel in a direction that is orthogonal to both the longitudinal axis Y5 of the sliding rail member 206

(and thus the longitudinal axis of the sliding rail assembly 204) and the longitudinal axis Y6 of the rail guide 202.

Referring again to FIGS. 4, 16, 18, 19, 22 and 23, in an exemplary implementation of the post-based slide mechanism 200 the difference between the just-described widths W1 and W2 is greater than or equal to 1.0 millimeters and less than or equal to 2.0 millimeters. The post-based sliding rail member 206 can optionally include one or more weight-reducing apertures (not shown) that serve to further reduce the weight of the post-based slide mechanism 200, where these apertures may be sized to be as large as possible without negatively affecting the structural integrity of the sliding rail member 206. Similarly, the post-based rail guide 202 can optionally include one or more weight-reducing apertures (also not shown) that serve to yet further reduce the weight of the slide mechanism 200, where these apertures may be sized to be as large as possible without negatively affecting the structural integrity of the rail guide 202. The exterior edges and corners on the slide mechanism 200 can optionally be rounded in order to prevent injury to the golfer and yet further reduce the weight of the slide mechanism 200.

As exemplified in FIGS. 5, 6 and 21-24, the guide block 218 of the post-based rail guide 202 also includes a rail travel distance limiting cavity 236 that is located on the bottom surface 238 of the rail guide's guide channel 226. It is noted that this rail travel distance limiting cavity 236 represents another embodiment of the aforementioned rail travel distance limiting feature 40. The rail travel distance limiting cavity 236 has the aforementioned width W3, the aforementioned length L2, and a prescribed depth D8 which is greater than the aforementioned protrusion distance. As exemplified in FIGS. 17-20, the post-based sliding rail member 206 includes a longitudinal aperture 240 that passes from the top of the sliding rail member 206 to the bottom 246 thereof (which is the bottom of the sliding rail block 212), where the longitudinal axis of this aperture 240 is aligned with the common longitudinal axis Y5 of both the barrel-mating post 210 and the sliding rail block 212. In other words, the aperture 240 is coaxial with both the barrel-mating post 210 and the sliding rail block 212. The aperture 240 has a prescribed radially cross-sectional shape and a prescribed diameter D9. As exemplified in FIG. 16, the post-based slide-limiting member 208 that is securely inserted into the aperture 240 includes an aperture-mating post 242 (which represents another embodiment of the aforementioned post 36) and a head 244 that is rigidly disposed onto the top of the post 242. The post 242 has a radially cross-sectional shape that is the same as the radially cross-sectional shape of the aperture 240. The post 242 also has a prescribed length L6 and the aforementioned diameter D2 that are selected to permit the post 242 to be fully and securely inserted downward into the aperture 240 so that the post 242 protrudes from the bottom 246 of the sliding rail member 206 after this insertion (a portion of this protrusion is shown in FIG. 4) and the bottom of the post 242 protrudes the protrusion distance into the rail travel distance limiting cavity 236.

Referring again to FIGS. 16-20, in one implementation of the post-based slide mechanism 200 the longitudinal aperture 240 can have a circular radially cross-sectional shape and can be threaded, and the radially outer surface of the aperture-mating post 242 can also be threaded in a manner that permits the post 242 to be threadably connected to the aperture 240, thus allowing the secure insertion of the post-based slide-limiting member 208 into the post-based sliding rail member 206 to be made by threadably fully inserting the post 242 into the aperture 240. In this particular implementation a lock-washer (not shown) can optionally be disposed onto the post 242 before it is threadably inserted into the aperture 240; when the post 242 is threadably fully inserted into the aperture 240 the lock-washer will become sandwiched between the bottom of the head 244 and the top of the barrel-mating post 210. In another implementation of the slide mechanism 200 where the aperture 240 is un-threaded and the radially outer surface of the post 242 is un-threaded, the aperture 240 can have any one of a variety of radially cross-sectional shapes (e.g., a circle, a square, and a hexagon, among other two-dimensional shapes) and the secure insertion of the slide-limiting member 208 into the sliding rail member 206 can be made by inserting the post 242 into the aperture 240 while the aforementioned strong adhesive is used to rigidly adhere the radially outer surface of the post 242 to the radial wall of the aperture 240.

Referring again to FIGS. 2-6 and 16-24, the ball bearing retainer feature 38 is generally adapted to retain the front ball bearings 26/28 in-between the front rail slot 222 and the front guide slot 232, and also retain the rear ball bearings 30/32 in-between the rear rail slot 224 and the rear guide slot 234, when the sliding rail block 212 of the post-based sliding rail member 206 is movably positioned within the guide channel 226 of the post-based rail guide 202. It is noted that the ball bearing retainer feature 38 can be realized in a variety of ways. By way of example but not limitation, in the post-based sliding rail assembly 204 embodiment that is shown in FIGS. 2-4 and 16-19 the ball bearing retainer feature 38 is realized as follows. The ball bearing retainer feature includes the aforementioned front ball bearing retainer members 110 and 114 and rear ball bearing retainer members 112 and 116. The sliding rail block 212 includes a pair of front retainer member cavities 248 and 250, and a pair of rear retainer member cavities 252 and 254, where the longitudinal axis of each of these cavities 248/250/252/254 lies along the aforementioned horizontal plane along which the rail slots 222 and 224 are positioned (as shown in FIGS. 17 and 19), and each of these cavities 248/250/252/254 has a size and shape that are adapted to allow the post (e.g., post 164) of a given one of the retainer members 110/112/114/116 to be fully and securely inserted into the cavity such that the head (e.g., head 166) of this retainer member contacts the left side 256 or the right side 258 of the sliding rail block 212 (as shown in FIGS. 2-4). In one implementation of the sliding rail assembly 204 each of the cavities 248/250/252/254 can have a circular radially cross-sectional shape and can be threaded, and the radially outer surface of the post of each of the retainer members 110/112/114/116 can also be threaded in a manner that permits it to be threadably connected to a given one of the cavities 248/250/252/254. As shown in FIGS. 3 and 4, the head of each of the retainer members 110/112/114/116 has a radial size that is selected to allow this head to cover a prescribed portion of a given one of the ends of a given one of the rail slots 222/224, where this portion is large enough to prevent the ball bearings 26/28/30/32 from falling out of the slide mechanism 200 after it has been completely assembled regardless of how the baseball bat is swung, and small enough to allow the aforementioned transverse/lateral movement of the assembly 204 relative to the guide 202 (e.g., the front ball bearing retainer members 110 and 114 retain the front ball bearings 26/28 in-between the front rail slot 222 and the front guide slot 232, and the rear ball bearing retainer members 112 and 116 retain the rear ball bearings 30/32 in-between the rear rail slot 224 and the rear guide slot 234).

As will be appreciated from FIGS. 4-6 and the functional operation of the post-based slide mechanism 200 described in this section, and referring again to FIGS. 16-24, after the post-based slide mechanism 200 has been completely assembled, the length L6 of the aperture-mating post 242 of the post-based slide-limiting member 208 is selected such that the bottom of this post 242 will protrude the aforementioned protrusion distance into the rail travel distance limiting cavity 236 on the post-based rail guide 202. As will now be described in more detail, this cavity 236 is adapted to limit the travel of the post-based sliding rail assembly 204 (e.g., limit the transverse/lateral movement/motion/shift) to the maximum rail travel distance D1 by limiting the travel of the post 242 to this distance D1. More particularly, the cavity 236 has one pair of opposing vertical sidewalls 176 and 178 that are parallel to each other and to the vertical sidewalls of the rail guide's linear guide channel 226. The cavity 236 has another pair of opposing vertical sidewalls 180 and 182 that are symmetrical to each other, where a horizontally central portion of both of these sidewalls 180 and 182 is orthogonal to the direction of slide/travel of the post-based sliding rail member 206, and thus the direction of slide/travel of post 242 of the slide-limiting member 208. As exemplified in FIGS. 5 and 6, both the width W3 and length L2 of the cavity 236 are greater than the diameter D2 of the post 242, thus permitting the post 242 to travel laterally (e.g., leftward and rightward from the perspective of FIGS. 2, 3, 5 and 6) within the cavity 236. As will be appreciated from FIGS. 5 and 6, the difference between the length L2 and the diameter D2 defines the distance D1. When the sliding rail assembly 204 is situated in the aforementioned coaxial position on the rail guide 202 the right side of the post 242 makes contact with the sidewall 182 as shown in FIG. 5. When the sliding rail assembly 204 is situated in the aforementioned maximally non-coaxial position on the rail guide 202 the left side of the post 242 makes contact with the sidewall 180 as shown in FIG. 6. Generally speaking, the length L2 and the diameter D2 can be selected so that the distance D1 can have any value, where this value is selected based on the stiffness of the baseball bat, among other factors. By way of example but not limitation, in an exemplary embodiment of the slide mechanism 200 the length L2 and the diameter D2 are selected so that the distance D1 is approximately 3.5 millimeters.

Given the foregoing and referring again to FIGS. 5, 6 and 16, it will be appreciated that the post-based slide mechanism 200 permits the batter to hear and feel the transverse/lateral movement/motion/shift of the lower end of the barrel section of the baseball bat relative to the upper end of the handle section of the bat when the batter swings the bat in a desired manner. In other words, when the slide mechanism 200 is interposed into the bat as described herein, the slide mechanism 200 provides the batter with the aforementioned audible and tactile feedback indicating whether or not they have achieved a desired swing profile. For example, when the bat is swung in a manner that makes the lower end of the bat's barrel section transversely/laterally move/shift leftward relative to the upper end of the bat's handle section such that the post-based sliding rail assembly 204 reaches the maximally non-coaxial position on the post-based rail guide 202 and the left side of the aperture-mating post 242 impacts the vertical sidewall 180 of the rail travel distance limiting cavity 236, the slide mechanism 200 will generate a discernible sound (e.g., the batter will hear a "click" sound) and will also generate a tactile sensation at the proximal end of the bat (e.g., the batter will feel a vibration that travels from the mechanism 200 through the bat's handle section and into their hands).

Figure 27:
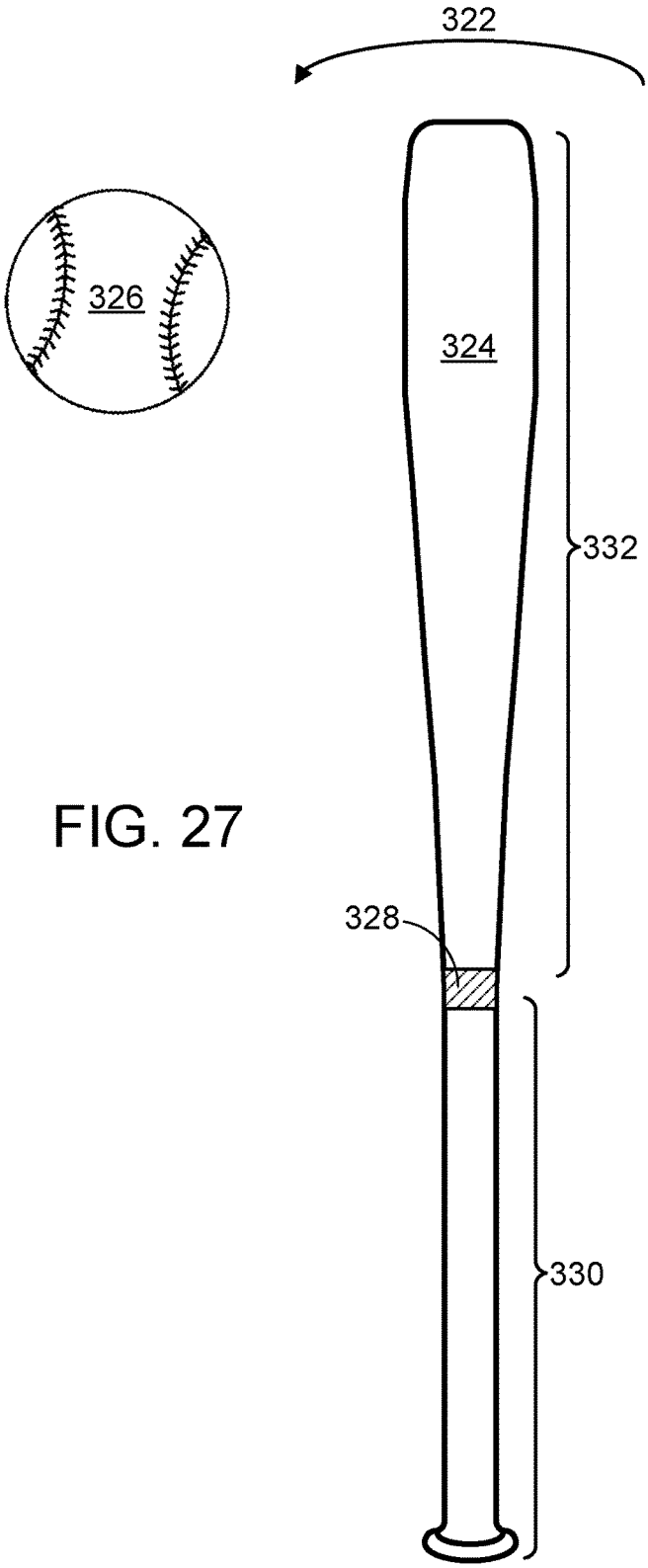
FIG. 27 is a diagram illustrating a plan view, in simplified form, of an exemplary embodiment of a conventional baseball bat and a conventional baseball, where a batter swings the bat in an attempt to hit the baseball.

FIG. 27 illustrates a plan view, in simplified form, of an exemplary embodiment of the aforementioned conventional baseball bat and baseball. As exemplified in FIG. 27 and referring again to FIG. 16, a batter swings 322 the baseball bat 324 in an attempt to hit the baseball 326. The bat 324 includes two separate and distinct sections that are spaced apart to form a gap 328 there-between, namely a handle section 330 and a barrel section 332. The post-based slide mechanism 200 is inserted within the gap 328, and is connected to the upper end of the handle section 330 and the lower end of the barrel section 332 as described heretofore.

1.3 Tennis Racket Application

The training apparatus embodiments described in this section are hereafter simply referred to as tennis-racket-related embodiments. These tennis-racket-related embodiments generally relate to the field of tennis rackets and more particularly to a tennis racket swing training apparatus that tennis players can use to improve the mechanics of how they swing their racket (e.g., perfect their swing) and thus become better tennis players.

Referring again to FIGS. 1-6 and 16, in the tennis-racket-embodiments described in this section the sports-related implement 10 is a conventional tennis racket and the object 18 is a conventional tennis ball. The distal section 12 of the implement includes a head section of the racket that includes an oval-shaped hoop the interior of which is "stringed" with a planar network of cord. The distal section 12 also includes the upper portion of a handle section of the racket and a throat section of the racket that rigidly interconnects the head section to the upper portion of the handle section. The proximal section 14 of the implement is the lower portion of the handle section of the racket. The slide mechanism 22 is the post-based slide mechanism 200. The tennis-racket-related embodiments are advantageous for various reasons including, but not limited to, the following. The tennis-racket-related embodiments can be used with any type of tennis racket including, but not limited to, rackets made from various types of wood, various types of light-weight metals, and various types of composite materials.

Referring again to FIG. 16 and as will be appreciated from the more-detailed description of the tennis-racket-related embodiments that follows, after the post-based slide mechanism 200 has been completely assembled and inserted in-between the upper portion of the racket's handle section and the lower portion of the racket's handle section, the forces incurred during a tennis player's successful use of the tennis-racket-related embodiments (that is, during a proper/preferred swing of the racket) will cause the aforementioned transverse/lateral movement/motion/shift of the upper portion of the racket's handle section (and thus the throat and head sections of the racket that extend from this upper portion) relative to the lower portion of the racket's handle section. Given the foregoing, it will be appreciated that this movement/motion/shift is confined to a direction that is orthogonal to both the longitudinal axis of this upper portion and the longitudinal axis of this lower portion, and is also confined to a direction that is orthogonal to the head section's planar network of cord, and is limited to the aforementioned maximum rail travel distance D1. This movement/motion/shift may in turn cause the slide mechanism 200 to provide the player with both audible and tactile feedback indicating whether or not they have achieved a desired swing profile. The particular value for the distance D1 is selected based on the stiffness of the racket, among other factors. By way of example but not limitation, in an exemplary embodiment of the tennis racket swing training apparatus described in this section the distance D1 is approximately 3.0 millimeters.

As exemplified in FIGS. 17-20 and referring again to FIG. 16, the upper portion of the post-based sliding rail member 206 is adapted to permit the lower end of the upper portion of the tennis racket's handle section to be securely connected to the upper portion of the sliding rail member 206 in a manner that insures the upper portion of the racket's handle section is coaxial with the post-based sliding rail assembly 204 regardless of how the racket is swung (e.g., the longitudinal axis of this lower end is orthogonal to the top surface 214 of the sliding rail block 212, and the bottom surface of the upper portion of the racket's handle section is flush with the surface 214, when this lower end is connected to the sliding rail member 206). It is noted that this secure connection can be realized in a variety of ways including, but not limited to, the different ways described in section 1.2 above. More particularly and by way of example but not limitation, in the post-based sliding rail member 206 embodiment that is shown in FIGS. 17-20 this adaptation is configured as follows. The barrel-mating post 210 has a radially cross-sectional shape that is the same as the radially cross-sectional shape of a longitudinal cavity that is formed on the lower end of the upper portion of the racket's handle section, where the longitudinal axis of this cavity is aligned with the longitudinal axis of the lower end of the upper portion of the racket's handle section. The longitudinal cavity can be formed on the lower end of the upper portion of the racket's handle section after the racket is cut and the aforementioned longitudinal section is removed.

As exemplified in FIGS. 21-24 and referring again to FIG. 16, the lower portion of the post-based rail guide 202 is adapted to permit the upper end of the lower portion of the tennis racket's handle section to be securely connected to the lower portion of the rail guide 202 in a manner that insures the lower portion of the racket's handle section is coaxial with the rail guide 202 regardless of how the racket is swung (e.g., the longitudinal axis of this upper end is orthogonal to the bottom surface 220 of the guide block 218, and the top surface of the lower portion of the racket's handle section is flush with the surface 220, when this upper end is connected to the rail guide 202). It is noted that this secure connection can be realized in a variety of ways including, but not limited to, the different ways described in section 1.2. More particularly and by way of example but not limitation, in the post-based sliding rail guide 202 embodiment that is shown in FIGS. 21-24 this adaptation is configured as follows. The handle-mating post 216 has a radially cross-sectional shape that is the same as the radially cross-sectional shape of a longitudinal cavity that is formed on the upper end of the lower portion of the racket's handle section, where the longitudinal axis of this cavity is aligned with the longitudinal axis of the upper end of the lower portion of the racket's handle section. The longitudinal cavity can be formed on the upper end of the lower portion of the racket's handle section after the racket is cut and the aforementioned longitudinal section is removed.

Given the foregoing and referring again to FIGS. 5, 6 and 16, it will be appreciated that the post-based slide mechanism 200 permits the tennis player to hear and feel the transverse/lateral movement/motion/shift of the upper portion of the tennis racket's handle section relative to the lower portion of the racket's handle section when the player swings the racket in a desired manner. In other words, when the slide mechanism 200 is interposed into the racket as described herein, the slide mechanism 200 provides the player with the aforementioned audible and tactile feedback indicating whether or not they have achieved a desired swing profile. For example, when the racket is swung in a manner that makes the upper portion of the racket's handle section transversely/laterally move/shift leftward relative to the lower portion of the racket's handle section such that the post-based sliding rail assembly 204 reaches the maximally non-coaxial position on the post-based rail guide 202 and the left side of the aperture-mating post 242 impacts the vertical sidewall 180 of the rail travel distance limiting cavity 236, the slide mechanism 200 will generate a discernible sound (e.g., the player will hear a "click" sound) and will also generate a tactile sensation at the proximal end of the racket (e.g., the player will feel a vibration that travels from the mechanism 200 through the lower portion of racket's handle section and into their hands).

Figure 28:
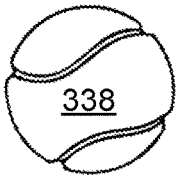
FIG. 28 is a diagram illustrating a plan view, in simplified form, of an exemplary embodiment of a conventional tennis racket and a conventional tennis ball, where a tennis player swings the racket in an attempt to hit the tennis ball.
Figure 29:
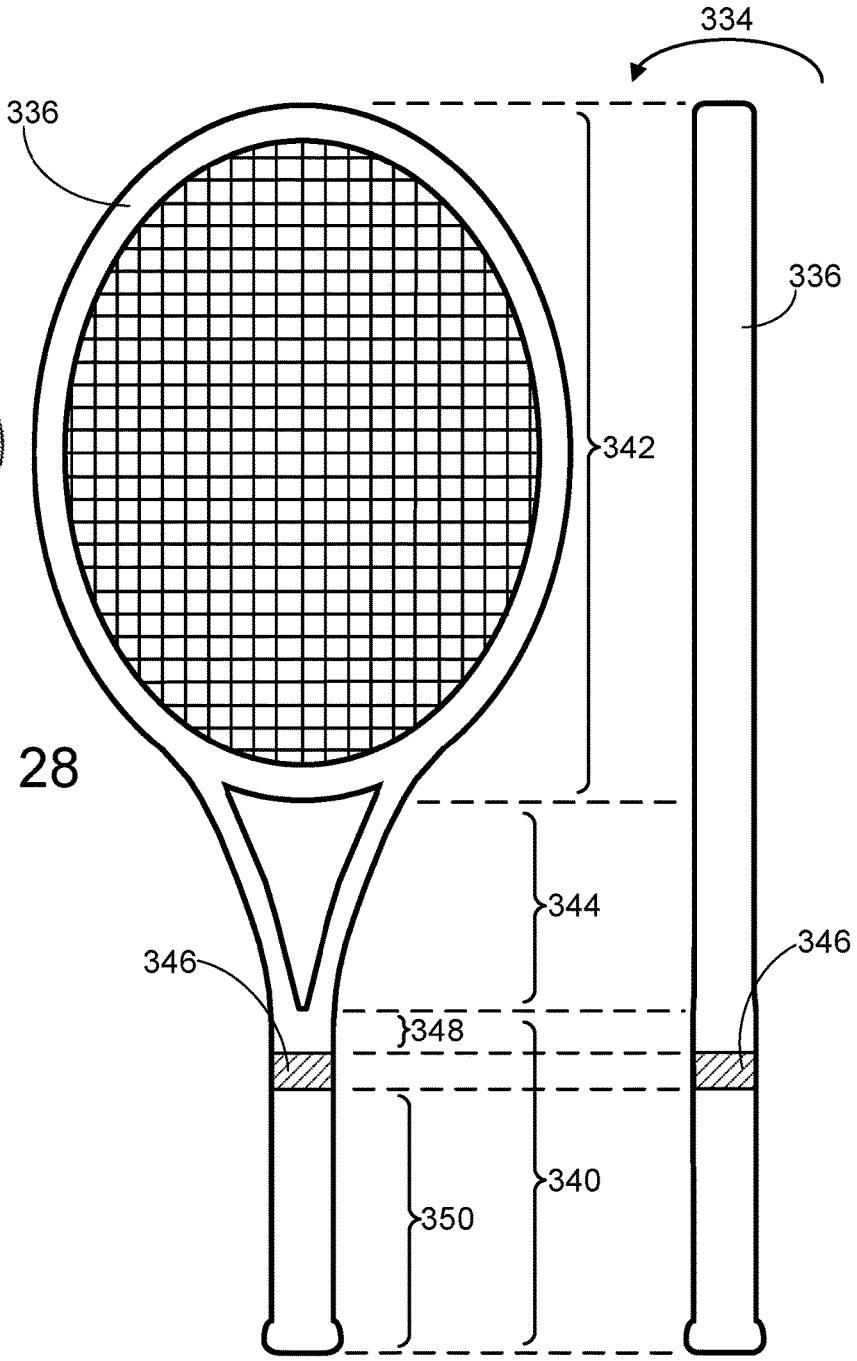
FIG. 29 is a diagram illustrating a plan view, in simplified form, of the tennis racket of FIG. 28 rotated left 90 degrees.

FIG. 28 illustrates a plan view, in simplified form, of an exemplary embodiment of the aforementioned conventional tennis racket and tennis ball. FIG. 29 illustrates a plan view, in simplified form, of the tennis racket of FIG. 28 rotated left 90 degrees. As exemplified in FIGS. 28 and 29, and referring again to FIG. 16, a tennis player swings 334 the tennis racket 336 in an attempt to hit the tennis ball 338. The racket 336 includes a handle section 340, a head section 342, and a throat section 344 that rigidly interconnects the handle and head sections 340 and 342. The handle section 340 of the racket 336 includes two separate and distinct portions that are spaced apart to form a gap 346 there-between, namely an upper portion 348 and a lower portion 350. The post-based slide mechanism 200 is inserted within the gap 346, and is connected to the upper end of the lower portion 350 of the handle section 340 and the lower end of the upper portion 348 of the handle section 340 as described heretofore.

2.0 Other Embodiments

While the training apparatus has been described by specific reference to embodiments thereof, it is understood that variations and modifications thereof can be made without departing from the true spirit and scope of the training apparatus. By way of example but not limitation, rather than the slide mechanism embodiments, (and related implementations and versions thereof) described herein being interposed/installed/inserted into either an existing conventional golf club or an existing conventional baseball bat or an existing conventional tennis racket as described heretofore, alternate embodiments of the training apparatus are also possible where the slide mechanism embodiments are directly manufactured into either a new training golf club or a new training baseball bat or a new training tennis racket. The slide mechanism embodiments can also be interposed/installed/inserted into any other type of conventional sports-related implement that is swung. For example, the slide mechanism embodiments can be interposed/installed/inserted into a hockey stick, or other types of bats (such as a cricket bat, or the like), or other types of rackets (such as a racquetball racket, or a paddle ball racket, or a badminton racket, or the like).

Figure 25:
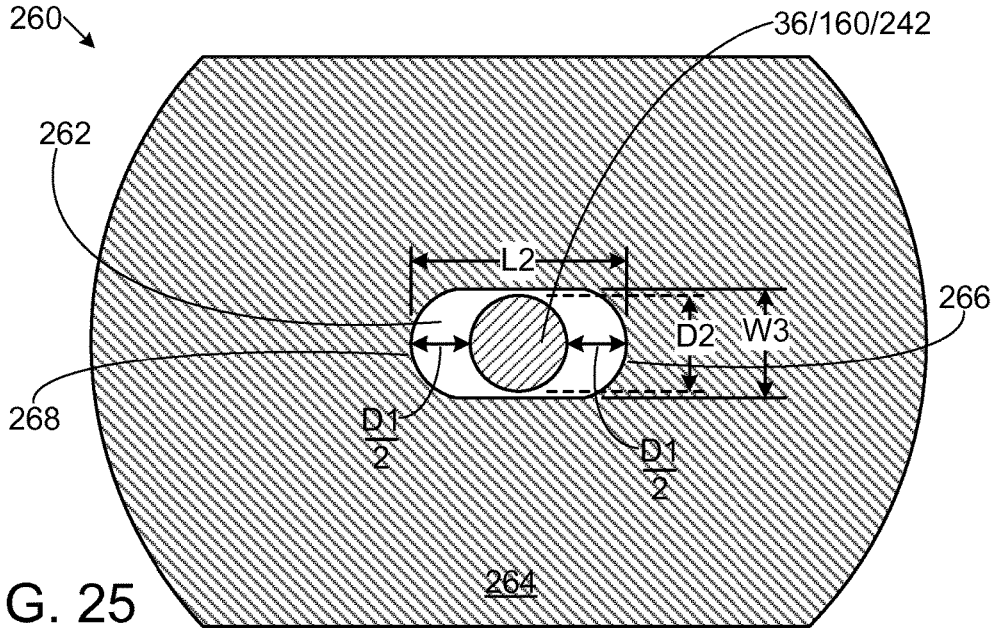
FIG. 25 is a diagram illustrating an enlarged cross-sectional view, in simplified form, of an alternate embodiment of the slide mechanism of FIG. 2 taken along line C-C of FIG. 2.

Additionally, FIG. 25 illustrates an enlarged cross-sectional view, in simplified form, of an alternate embodiment of the slide mechanism of FIG. 2 taken along line C-C of FIG. 2. The alternate slide mechanism embodiment 260 shown in FIG. 25 is applicable to both the cavity-based and the post-based embodiments of the slide mechanism described heretofore. As such, the alternate slide mechanism embodiment 260 can be used with any of the aforementioned different types of sports-related implements that a person swings. However, as will be appreciated from the more detailed description of the alternate slide mechanism embodiment 260 that follows, this particular embodiment is especially advantageous when used with a baseball bat since it allows right-handed batters and left-handed batters to hold the bat in the same way.

Referring again to FIGS. 5, 6 and 25, the alternate slide mechanism embodiment 260 is the same as the slide mechanism 22 embodiments described heretofore with the following exception. As exemplified in FIG. 25, in the alternate slide mechanism embodiment 260 the rail travel distance limiting feature 262 on the rail guide 264 (which corresponds to the aforementioned rail travel distance limiting feature 40 on the rail guide 24) is shifted rightward such that it is centrally located on the bottom surface of the rail guide's 264 guide channel (not shown). In other words, the longitudinal axis of the rail travel distance limiting feature 262 is aligned with the common longitudinal axis of the rail guide (e.g., the aforementioned common longitudinal axes Y4 and Y6). Accordingly, when the aforementioned sliding rail assembly (not show) is situated in the aforementioned coaxial position on the rail guide 264 the aforementioned post 36/160/242 of the slide-limiting member is located in the center of the rail travel distance limiting feature 262. When the sliding rail assembly is situated in a rightmost position on the rail guide 264 (which can happen when the sports-related implement is swung in a manner that makes the lower end of the implement's distal section transversely/laterally move/shift rightward relative to the upper end of the implement's proximal section) the right side of the post 36/160/242 makes contact with the sidewall 266 of the rail travel distance limiting feature 262. When the sliding rail assembly is situated in a leftmost position on the rail guide 264 (which can happen when the sports-related implement is swung in a manner that makes the lower end of the implement's distal section transversely/laterally move/shift leftward relative to the upper end of the implement's proximal section) the left side of the post 36/160/242 makes contact with the sidewall 268 of the rail travel distance limiting feature 262. Given the foregoing, it will be appreciated that the rail travel distance between the just-described coaxial and rightmost positions is one half the aforementioned maximum rail travel distance D1 (which is 1.75 millimeters when D1 is 3.5 millimeters). Similarly, the rail travel distance between the coaxial and just-described leftmost positions is also one half the distance D1.

It is noted that any or all of the aforementioned embodiments throughout the description may be used in any combination desired to form additional hybrid embodiments. In addition, although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What has been described above includes example embodiments. It is, of course, not possible to describe every conceivable combination of components or methodologies for purposes of describing the claimed subject matter, but one of ordinary skill in the art may recognize that many further combinations and permutations are possible. Accordingly, the claimed subject matter is intended to embrace all such alterations, modifications, and variations that fall within the spirit and scope of the appended claims. In regard to the various functions performed by the above described components, and the like, the terms (including a reference to a "means") used to describe such components are intended to correspond, unless otherwise indicated, to any component which performs the specified function of the described component (e.g., a functional equivalent), even though not structurally equivalent to the disclosed structure, which performs the function in the herein illustrated exemplary aspects of the claimed subject matter.

Wherefore, what is claimed is:

1. A universal swing training apparatus, comprising:

a sports-related implement comprising two separate and distinct sections spaced apart to form a gap therebetween, said sections comprising a proximal section and a distal section; and a slide mechanism inserted within said gap and connected to an upper end of the proximal section and a lower end of the distal section, the slide mechanism comprising a rail guide, a plurality of front ball bearings, a plurality of rear ball bearings, and a sliding rail assembly that are cooperatively configured to, insure said upper end and said lower end are coaxial when the sliding rail assembly is situated in a coaxial position on the rail guide, and permit a lateral shift of said lower end relative to said upper end during a swinging of the implement.

2. The apparatus of claim 1, wherein, the sliding rail assembly comprises a sliding rail member, and an upper portion of the sliding rail member is adapted to permit said lower end to be connected to said upper portion in a manner that insures said lower end is coaxial with the sliding rail assembly regardless of how the implement is swung.

3. The apparatus of claim 1, wherein a lower portion of the rail guide is adapted to permit said upper end to be connected to said lower portion in a manner that insures said upper end is coaxial with the rail guide regardless of how the implement is swung.

4. The apparatus of claim 1, wherein, the sliding rail assembly comprises a sliding rail member, a lower portion of the sliding rail member comprises a sliding rail block, an upper portion of the rail guide comprises a guide block, an upper portion of the guide block comprises a linear guide channel that passes from a left side of the guide block to a right side thereof, and the linear guide channel is adapted to receive a combination of the sliding rail block and the front and rear ball bearings in sliding engagement when said combination is slidably inserted into the linear guide channel, said sliding engagement permitting the sliding rail assembly to travel in a direction that is orthogonal to both a longitudinal axis of the sliding rail assembly and a longitudinal axis of the rail guide.

5. The apparatus of claim 4, wherein, the sliding rail block comprises a prescribed width W1 (W1) and a pair of opposing elongated rail slots comprising a front rail slot and a rear rail slot, said rail slots are positioned such that their longitudinal axes lie along a plane that is orthogonal to a longitudinal axis of the sliding rail member, a vertical axis of the linear guide channel is aligned with the longitudinal axis of the rail guide, the linear guide channel comprises parallel vertical sidewalls, a pair of opposing elongated guide slots, and a prescribed width W2 (W2) that is slightly greater than the width W1 (W1), thus allowing the sliding rail block to be movably positioned within the linear guide channel, said guide slots comprise a front guide slot that resides on one of the sidewalls of the linear guide channel, and a rear guide slot that resides on the other of the sidewalls of the linear guide channel, said guide slots are positioned on their respective sidewalls such that a longitudinal axis of each of said guide slots lies along a plane that is orthogonal to the longitudinal axis of the rail guide, the front rail slot and the front guide slot comprise a common shape that is slightly less than semi-circular and is sized to allow the front rail slot and the front guide slot to receive the front ball bearings in low-friction rolling engagement when the sliding rail block is positioned within the linear guide channel, and the rear rail slot and the rear guide slot comprise a common shape that is slightly less than semi-circular and is sized to allow the rear rail slot and the rear guide slot to receive the rear ball bearings in low-friction rolling engagement when the sliding rail block is positioned within the linear guide channel.

6. The apparatus of claim 5, wherein a difference between the widths W1 (W1) and W2 (W2) is greater than or equal to 1.0 millimeter and less than or equal to 2.0 millimeters.

7. The apparatus of claim 1, wherein, the sliding rail assembly comprises a slide-limiting member comprising a post, the rail guide comprises a rail travel distance limiting feature, a bottom of the post protrudes a prescribed protrusion distance into said distance limiting feature after the slide mechanism has been assembled, and the post and said distance limiting feature are cooperatively configured to limit said lateral shift to a prescribed maximum rail travel distance D1 (D1).

8. The apparatus of claim 1, wherein upon said lateral shift the slide mechanism generates a tactile sensation and a discernible sound.

9. The apparatus of claim 1, wherein, the sliding rail assembly comprises a sliding rail member, a lower portion of the sliding rail member comprises a sliding rail block comprising a front rail slot and a rear rail slot, an upper portion of the rail guide comprises a guide block, an upper portion of the guide block comprises a linear guide channel comprising a front guide slot and a rear guide slot, and the sliding rail member further comprises a ball bearing retainer feature that is adapted to retain the front ball bearings in-between the front rail slot and the front guide slot when the sliding rail block is positioned within the linear guide channel, and also retain the rear ball bearings in-between the rear rail slot and the rear guide slot when the sliding rail block is positioned within the linear guide channel, regardless of how the implement is swung.

10. The apparatus of claim 9, wherein, the front and rear rail slots are positioned such that a longitudinal axis of each of said rail slots lies along a plane that is orthogonal to a longitudinal axis of the sliding rail member, the ball bearing retainer feature comprises a pair of front ball bearing retainer members and a pair of rear ball bearing retainer members, each of said retainer members comprises a post and a head that is rigidly disposed onto one end of the post, the sliding rail block further comprises a pair of front retainer member cavities and a pair of rear retainer member cavities, a longitudinal axis of each of the front and rear retainer member cavities lies along said plane, each of the front and rear retainer member cavities comprises a size and shape that are adapted to allow the post of a given one of said retainer members to be fully and securely inserted into said cavity such that the head of said retainer member contacts either a left side or a right side of the sliding rail block, and the head of each of said retainer members comprises a radial size that is selected to allow said head to cover a prescribed portion of a given one of the ends of a given one of said rail slots, said portion being large enough to prevent the front and rear ball bearings from falling out of the slide mechanism after it has been assembled, said portion being small enough to allow said lateral shift.

11. The apparatus of claim 1, wherein the coaxial position comprises a rightmost position and said lateral shift occurs in a leftward direction from the rightmost position.

12. The apparatus of claim 1, wherein the coaxial position comprises a central position, said lateral shift occurs in a leftward direction when the implement is swung leftward, and said lateral shift occurs in a rightward direction when the implement is swung rightward.

13. A golf club swing training apparatus, comprising:

a golf club shaft having a butt end and a head end, the shaft comprising two separate and distinct portions spaced apart to form a gap there-between, said portions comprising an upper shaft portion comprising the butt end of the shaft and a lower shaft portion comprising the head end of the shaft; and a slide mechanism inserted within said gap and connected to a lower end of the upper shaft portion and an upper end of the lower shaft portion, the slide mechanism comprising a rail guide, a plurality of front ball bearings, a plurality of rear ball bearings, and a sliding rail assembly that are cooperatively configured to, insure said lower end and said upper end are coaxial when the sliding rail assembly is situated in a coaxial position on the rail guide, and permit a lateral shift of said upper end relative to said lower end during a swinging of the club.

14. The apparatus of claim 13, wherein, the sliding rail assembly comprises a sliding rail member, an upper portion of the sliding rail member comprises an upper connector that is adapted to permit said upper end to be connected to the upper connector in a manner that insures said upper end is coaxial with the sliding rail assembly regardless of how the club is swung, and a lower portion of the rail guide comprises a lower connector that is adapted to permit said lower end to be connected to the lower connector in a manner that insures said lower end is coaxial with the rail guide regardless of how the club is swung.

15. The apparatus of claim 13, wherein, the sliding rail assembly comprises a sliding rail member, a lower portion of the sliding rail member comprises a sliding rail block, an upper portion of the rail guide comprises a guide block, an upper portion of the guide block comprises a linear guide channel that passes from a left side of the guide block to a right side thereof, and the linear guide channel is adapted to receive a combination of the sliding rail block and the front and rear ball bearings in sliding engagement when said combination is slidably inserted into the linear guide channel, said sliding engagement permitting the sliding rail assembly to travel in a direction that is orthogonal to both a longitudinal axis of the sliding rail assembly and a longitudinal axis of the rail guide.

16. The apparatus of claim 15, wherein, an upper portion of the sliding rail member comprises an upper connector, a top end of the upper connector comprises a cylindrical cavity that is coaxial with the upper connector, a bottom of the upper connector is rigidly disposed onto a central position on a top surface of the sliding rail block such that the cylindrical cavity and the sliding rail block have a common longitudinal axis which is orthogonal to said top surface, the guide block further comprises a rail travel distance limiting aperture that is located on a bottom surface of the linear guide channel, said distance limiting aperture comprises a prescribed width W3 (W3) and a prescribed length L2 (L2), and is adapted to limit said lateral shift to a prescribed maximum rail travel distance D1 (D1), the sliding rail member further comprises a longitudinal aperture that passes from the cylindrical cavity to a bottom of the sliding rail member, a longitudinal axis of the longitudinal aperture is aligned with said common longitudinal axis, the sliding rail assembly further comprises a slide-limiting member comprising a post, the post comprises a radially cross-sectional shape that is the same as a radially cross-sectional shape of the longitudinal aperture, the post further comprises a prescribed length L3 (L3) and a prescribed diameter D2 (D2) that are selected to permit the post to be securely inserted into the longitudinal aperture so that the post protrudes from the bottom of the sliding rail member, and a bottom of the post protrudes a prescribed protrusion distance into said distance limiting aperture after the slide mechanism has been assembled, both the width W3 (W3) and the length L2 (L2) are greater than the diameter D2 (D2), thus permitting the post to travel laterally within said distance limiting aperture, and a difference between the length L2 (L2) and the diameter D2 (D2) defines the distance D1 (D1).

17. The apparatus of claim 13, wherein said lateral shift is limited to a distance of approximately 0.65 millimeter.

18. A baseball bat swing training apparatus, comprising:

a baseball bat comprising two separate and distinct sections spaced apart to form a gap there-between, said sections comprising a handle section and a barrel section; and a slide mechanism inserted within said gap and connected to an upper end of the handle section and a lower end of the barrel section, the slide mechanism comprising a rail guide, a plurality of front ball bearings, a plurality of rear ball bearings, and a sliding rail assembly that are cooperatively configured to, insure said upper end and said lower end are coaxial when the sliding rail assembly is situated in a coaxial position on the rail guide, and permit a lateral shift of said lower end relative to said upper end during a swinging of the bat.

19. The apparatus of claim 18, wherein, the sliding rail assembly comprises a sliding rail member, an upper portion of the sliding rail member comprises a barrel-mating post that is adapted to permit said lower end to be connected to the barrel-mating post in a manner that insures said lower end is coaxial with the sliding rail assembly regardless of how the bat is swung, and a lower portion of the rail guide comprises a handle-mating post that is adapted to permit said upper end to be connected to the handle-mating post in a manner that insures said upper end is coaxial with the rail guide regardless of how the bat is swung.

20. The apparatus of claim 18, wherein, the sliding rail assembly comprises a sliding rail member, a lower portion of the sliding rail member comprises a sliding rail block, an upper portion of the rail guide comprises a guide block, an upper portion of the guide block comprises a linear guide channel that passes from a left side of the guide block to a right side thereof, and the linear guide channel is adapted to receive a combination of the sliding rail block and the front and rear ball bearings in sliding engagement when said combination is slidably inserted into the linear guide channel, said sliding engagement permitting the sliding rail assembly to travel in a direction that is orthogonal to both a longitudinal axis of the sliding rail assembly and a longitudinal axis of the rail guide.

21. The apparatus of claim 20, wherein, an upper portion of the sliding rail member comprises a barrel-mating post, a bottom of the barrel-mating post is rigidly disposed onto a central position on a top surface of the sliding rail block such that the barrel-mating post and the sliding rail block have a common longitudinal axis which is orthogonal to said top surface, the guide block further comprises a rail travel distance limiting cavity that is located on a bottom surface of the linear guide channel, said distance limiting cavity comprises a prescribed width W3 (W3), a prescribed length L2 (L2), and a prescribed depth D8 (D8), and is adapted to limit said lateral shift to a prescribed maximum rail travel distance D1 (D1), the sliding rail member further comprises a longitudinal aperture that passes from a top of the sliding rail member to a bottom thereof, a longitudinal axis of the longitudinal aperture is aligned with said common longitudinal axis, the sliding rail assembly further comprises a slide-limiting member comprising an aperture-mating post, the aperture-mating post comprises a radially cross-sectional shape that is the same as a radially cross-sectional shape of the longitudinal aperture, the aperture-mating post further comprises a prescribed length L6 (L6) and a prescribed diameter D2 (D2) that are selected to permit the aperture-mating post to be securely inserted into the longitudinal aperture so that the aperture-mating post protrudes from a bottom of the sliding rail member, and a bottom of the aperture-mating post protrudes a prescribed protrusion distance into said distance limiting cavity after the slide mechanism has been assembled, both the width W3 (W3) and the length L2 (L2) are greater than the diameter D2 (D2), and the depth D8 (D8) is greater than the protrusion distance, thus permitting the aperture-mating post to travel laterally within said distance limiting cavity, and a difference between the length L2 (L2) and the diameter D2 (D2) defines the distance D1 (D1).

22. The apparatus of claim 18, wherein said lateral shift is limited to a distance of approximately 3.5 millimeters.

23. A tennis racket swing training apparatus, comprising:

a tennis racket comprising a handle section, a head section, and a throat section that rigidly interconnects the handle and head sections, the handle section comprising two separate and distinct portions spaced apart to form a gap there-between, said portions comprising an upper portion and a lower portion; and a slide mechanism inserted within said gap and connected to an upper end of a lower portion of the handle section and a lower end of an upper portion of the handle section, the slide mechanism comprising a rail guide, a plurality of front ball bearings, a plurality of rear ball bearings, and a sliding rail assembly that are cooperatively configured to, insure said upper end and said lower end are coaxial when the sliding rail assembly is situated in a coaxial position on the rail guide, and permit a lateral shift of said lower end relative to said upper end during a swinging of the racket.

24. The apparatus of claim 23, wherein said lateral shift is limited to a distance of approximately 3.0 millimeters.

* * * * *